US008878641B2

(12) United States Patent
Nishikawa et al.

(10) Patent No.: US 8,878,641 B2
(45) Date of Patent: Nov. 4, 2014

(54) ELECTRONIC COMPONENT

(75) Inventors: Tomonaga Nishikawa, Tokyo (JP); Makoto Yoshida, Tokyo (JP); Tomokazu Ito, Tokyo (JP); Hiroshi Kamiyama, Tokyo (JP); Takeshi Okumura, Tokyo (JP); Tsuneo Kuwahara, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 13/294,627

(22) Filed: Nov. 11, 2011

(65) Prior Publication Data

US 2012/0133472 A1 May 31, 2012

(30) Foreign Application Priority Data

Nov. 26, 2010 (JP) ..... 2010-263963

(51) Int. Cl.

| | |
|---|---|
| ***H01F 5/00*** | (2006.01) |
| ***H01F 27/28*** | (2006.01) |
| ***H01F 17/04*** | (2006.01) |
| ***H01F 27/29*** | (2006.01) |
| *H01F 41/04* | (2006.01) |

(52) U.S. Cl.

CPC ..... *H01F 17/04* (2013.01); *H01F 27/292* (2013.01); *H01F 41/042* (2013.01)

USPC ..... 336/200; 336/232

(58) Field of Classification Search

USPC ..... 336/200, 232

See application file for complete search history.

(56) References Cited

U.S. PATENT DOCUMENTS

| | | | | |
|---|---|---|---|---|
| 5,515,022 | A * | 5/1996 | Tashiro et al. | 336/200 |
| 7,843,701 | B2 | 11/2010 | Kudo et al. | |
| 2002/0057174 | A1 * | 5/2002 | Uchikoba et al. | 336/200 |
| 2005/0219027 | A1 * | 10/2005 | Satoh et al. | 336/83 |
| 2007/0040163 | A1 * | 2/2007 | Okuzawa et al. | 257/31 |
| 2007/0069836 | A1 * | 3/2007 | Sato et al. | 333/185 |
| 2010/0157565 | A1 * | 6/2010 | Yoshida et al. | 361/811 |

FOREIGN PATENT DOCUMENTS

| | | | |
|---|---|---|---|
| CN | 1929050 | A | 3/2007 |
| JP | 2000-114047 | A | 4/2000 |
| JP | 2006324489 | A * | 11/2006 |
| JP | 2007-053254 | | 3/2007 |
| JP | 2007-066973 | A | 3/2007 |
| JP | 2007-103475 | A | 4/2007 |
| JP | 2007-259026 | A | 10/2007 |
| WO | WO 2006/073029 | A1 | 7/2006 |
| WO | WO-2010/087220 | A1 | 8/2010 |

* cited by examiner

*Primary Examiner* — Tsz Chan

(74) *Attorney, Agent, or Firm* — McDermott Will & Emery LLP

(57) ABSTRACT

An electronic component is provided with a substrate, a thin-film element layer provided on the substrate, first and second bump electrodes, provided on a surface of the thin-film element layer, and an insulator layer provided between the first bump electrode and the second bump electrode. The thin-film element layer contains a first spiral conductor which is a plane coil pattern. The first bump electrode is connected to an internal peripheral end of the first spiral conductor. The second bump electrode is connected to an external peripheral end of the first spiral conductor. Both of the first and second bump electrodes, have a first exposure surface exposed to a principal surface of the insulator layer and a second exposure surface exposed to an end face of the insulator layer.

12 Claims, 16 Drawing Sheets

ELECTRONIC COMPONENT

TECHNICAL FIELD

The present invention relates to an electronic component, and in particular, relates to a structure of a thin-film common mode filter containing coil conductor.

BACKGROUND OF THE INVENTION

In recent years, the standards of USB 2.0 and IEEE1394 are widely distributed as high-speed signal transmission interfaces and used in a large number of digital devices such as personal computers and digital cameras. These interfaces adopt the differential transmission method that transmits a differential signal by using a pair of signal lines to realize faster signal transmission than the conventional single end transmission method.

A common mode filter is widely used as a filter to remove noise on a high-speed differential transmission line. The common mode filter has characteristics that the impedance to a differential component of signals transmitted in a pair of signal lines is low and the impedance to a common mode component (common mode noise) is high. Therefore, by inserting a common mode filter between a pair of signal lines, common mode noise can be cut off without substantially attenuating a differential mode signal.

FIG. 16 is a schematic exploded perspective view showing an example of the structure of a conventional surface-mounted common mode filter.

As shown in FIG. 16, a conventional common mode filter 1 includes a thin-film coil layer 2 containing a pair of spiral conductors 5, 6 that are mutually electromagnetically coupled and magnetic substrates 3*a*, 3*b* provided above and below the thin-film coil layer 2 and made of ferrite. The thin-film coil layer 2 includes first to fourth insulating layers 2*a* to 2*d* stacked sequentially, a first spiral conductor 5 formed on the surface of the first insulating layer 2*a*, a second spiral conductor 6 formed on the surface of the second insulating layer 2*b*, and first and second lead conductors 8*a*, 8*b* formed on the surface of the third insulating layer 2*c*.

An internal peripheral end 5*a* of the first spiral conductor 5 is connected to a first external terminal electrode 7*a* via a contact hole conductor 9*a* passing through the second and third insulating layers 2*b*, 2*c* and the first lead conductor 8*a* and an internal peripheral end 6*a* of the second spiral conductor 6 is connected to a third external terminal electrode 7*c* via a contact hole conductor 9*b* passing through the third insulating layers 2*c* and the second feeder conductor 8*b*. External peripheral ends 5*b*, 6*b* of the first and second spiral conductors 5, 6 are connected to external terminal electrodes 7*b*, 7*d* respectively. The external terminal electrodes 7*a* to 7*d* are formed on side faces and upper and lower surfaces of the magnetic substrates 3*a*, 3*b*. The external terminal electrodes 7*a* to 7*d* are normally formed by sputtering or plating of the surface of the magnetic substrates 3*a*, 3*b*.

An opening 2*h* passing through the first to fourth insulating layers 2*a* to 2*d* is provided in a central region of the first to fourth insulating layers 2*a* to 2*d* and on an inner side of the first and second spiral conductors 5, 6 and a magnetic core 4 to form a magnetic circuit is formed inside the opening 2*h*.

WO 2006/073029 discloses a terminal electrode structure of a common mode filter. The terminal electrode of the common mode filter has an Ag film formed by applying a conductive paste containing Ag to the surface of a component or by sputtering or vapor deposition and then a metal film of Ni is further formed by performing wet type electrolytic plating on the Ag film.

Japanese Patent Application Laid-Open No. 2007-53254 discloses a common mode choke coil having an outer shape of rectangular parallelepiped as a whole by successively forming an insulating layer, a coil layer containing a coil conductor, and an external electrode electrically connected to the coil conductor on a silicon substrate by thin-film formation technology. In the common mode choke coil, the external electrode is formed by extending on the upper surface (mounting surface) of the insulating layer. An internal electrode terminal is constituted as an electrode of a multi-layered structure in which a plurality of conductive layers is stacked.

The conventional common mode filter 1 shown in FIG. 16 has a structure in which the thin-film coil layer 2 is sandwiched between the two magnetic substrates 3*a*, 3*b* and thus has not only high magnetic properties and excellent high-frequency properties, but also high mechanical strength. However, the structure of the conventional common mode filter uses the upper and lower magnetic substrates 3*a*, 3*b* made of ferrite and a ferrite substrate is easy to break when thinned too much, making slimming-down of the substrate difficult. Further, the filter is made thicker by the two magnetic substrates 3*a*, 3*b* being stacked, which makes it difficult to provide as a lowered chip product. Moreover, a large amount of expensive magnetic materials is used, posing problems of high manufacturing costs and excessive specs of filter performance depending on uses.

Moreover, the conventional common mode filter 1 has the four micro external terminal electrodes 7*a* to 7*d* formed on the surface of individual chip components by sputtering or the like, posing a problem that it is very difficult to form the external terminal electrodes 7*a* to 7*d* with high precision. Because the four external terminal electrodes have the same shape and size and thus, which external terminal electrode is connected to an internal peripheral end or external peripheral end cannot be determined. Further, the internal electrode terminal is formed of many stacked conductor layers in a common mode choke coil described in Japanese Patent Application Laid-Open No. 2007-53254 and thus, the probability of a failed electrode being formed is high and a problem of increased manufacturing costs due to an increase in man-hour for the electrode formation is caused.

SUMMARY OF THE INVENTION

It is therefore an object of the present invention to provide an electronic component that can be miniaturized, lowered, and manufactured at a low cost while desired filter performance being secured.

To solve the above problems, an electronic component according to the present invention includes a substrate, a thin-film element layer provided on the substrate, first and second bump electrodes provided on a surface of the thin-film element layer, and an insulator layer provided between the first bump electrode and the second bump electrode, wherein the thin-film element layer contains a first spiral conductor, which is a plane coil pattern, the first bump electrode is connected to an internal peripheral end of the first spiral conductor, the second bump electrode is connected to an external peripheral end of the first spiral conductor, both of the first and second bump electrodes have a first exposure surface exposed to a principal surface of the insulator layer and a second exposure surface exposed to an end face of the insulator layer, and the first exposure surface of the first bump electrode and the first exposure surface of the second bump electrode have different shapes and sizes.

According to the present invention, a thin electronic component whose one substrate is omitted can be provided at a low cost. An electrode can be formed with higher precision than in the past because a bump electrode for which two-dimensional management with high precision is possible is used as an external terminal electrode. Also, an insulator layer is provided around the bump electrode and therefore, the bump electrode can be reinforced to prevent peeling of the bump electrode. Further, a portion of the bump electrode overlaps with the spiral conductor in plane view and therefore, the electronic component can be miniaturized. Further, according to the present invention, which bump electrode is connected to the internal peripheral end side or external peripheral end side of the spiral conductor can be distinguished and therefore, the orientation of mounting of the electronic component can easily be grasped from a bump electrode pattern. The principal surface of the insulator layer is a surface perpendicular to the stacking direction of an electronic component including the substrate, thin-film element layer, and insulator layer and corresponds to a future mounting surface. The end face of the insulator layer refers to four surfaces parallel to the stacking direction and corresponds to the thickness of the insulator layer.

In the present invention, it is preferable that an area of the first exposure surface of the first bump electrode is larger than that of the second bump electrode. According to the configuration, the distance from the first bump electrode to the internal peripheral end of the first spiral conductor can be shortened and therefore, the lead conductor to connect both electrically can be made shorter or the lead conductor itself can be omitted.

In the present invention, the thin-film element layer further contains an insulating layer covering the first spiral conductor and a first contact hole conductor electrically connecting the internal peripheral end of the first spiral conductor and the first bump electrode by passing through the insulating layer and the first bump electrode is preferably provided so as to cover the first contact hole conductor on the insulating layer. According to the configuration, the lead conductor connecting both can be omitted.

The electric component according to the present invention further includes a first lead conductor provided on the surface of the thin-film element layer together with the first and second bump electrodes and formed integrally with the first bump electrode, wherein the thin-film element layer further contains an insulating layer covering the first spiral conductor and a first contact hole conductor electrically connecting the internal peripheral end of the first spiral conductor and an end of the first lead conductor by passing through the insulating layer and the first bump electrode is preferably connected to the first contact hole conductor via the first lead conductor.

According to the configuration, there is no need to form a first lead conductor in the thin-film element layer and a dedicated insulating layer needed when a first lead conductor is formed in a conventional thin-film element layer can be omitted and therefore, thinner electronic components can be provided. With one layer of the insulating layer omitted, the distance between the insulator layer made of, for example, composite ferrite and the thin-film element layer is brought closer to each other as a common mode filter so that the common mode impedance can be increased. Further, material costs and man-hours are reduced with the omission of the insulating layer and an independent lead conductor and therefore, coil components that can be manufactured at a low cost can be provided. Further, a terminal electrode pattern for a portion of lead conductors conventionally formed in the thin-film element layer is no longer needed and the terminal electrode pattern can be removed so that a coil arrangement region can be increased. Therefore, the DC resistance Rdc can be reduced by broadening the line width of the spiral conductor. Also, by increasing the number of turns of the spiral conductor, the common mode impedance Zc can be increased.

The electronic component according to the present invention preferably further includes a circuit element pattern electrically connected to one of the internal peripheral end and the external peripheral end of the first spiral conductor. According to the configuration, the orientation of mounting of the electronic component arises due to asymmetry of the circuit caused by addition of a circuit element and the shape and size of the first bump electrode are different from those of the second bump electrode and therefore, the orientation of mounting can easily be grasped. Moreover, the orientation thereof can visually be recognized from one mounting surface of the electronic component, which makes automation of mounting easier.

The electric component according to the present invention further includes third and fourth bump electrodes provided on the surface of the thin-film element layer, wherein the thin-film element layer further contains a second spiral conductor magnetically coupled to the first spiral conductor and composed of a plane coil pattern, the insulator layer is provided between the first to fourth bump electrodes, the third bump electrode is connected to an internal peripheral end of the second spiral conductor, the fourth bump electrode is connected to an external peripheral end of the second spiral conductor, both of the third and fourth bump electrodes have a first exposure surface exposed to the principal surface of the insulator layer and a second exposure surface exposed to the end face of the insulator layer, and it is preferable that the first exposure surface of the third bump electrode and the first exposure surface of the fourth bump electrode have mutually different shapes and sizes. In this case, it is preferable that the first exposure surface of the first bump electrode and the first exposure surface of the third bump electrode have the same shape and size and the first exposure surface of the second bump electrode and the first exposure surface of the fourth bump electrode have the same shape and size.

According to the configuration, a common mode filter achieving the above operation/effect can be provided. While the demand for miniaturization of the common mode filter is strong, the area of individual external terminal electrodes is unavoidably small due to a 4-terminal structure. However, if the external terminal electrode is formed as a bump electrode, the bump electrode can be formed with high dimensional accuracy so that insulation between adjacent terminal electrodes can be secured. Further, according to the present invention, the orientation of mounting can easily be grasped in the common mode filter.

An electronic component according to the present invention includes a substrate, a thin-film element layer provided on the substrate, first and second bump electrodes provided on a surface of the thin-film element layer, and an insulator layer provided between the first bump electrode and the second bump electrode, wherein the thin-film element layer contains first and second elements connected to each other, the first bump electrode is connected to the first element, the second bump electrode is connected to the second element, both of the first and second bump electrodes have a first exposure surface exposed to a principal surface of the insulator layer, and the first exposure surface of the first bump electrode and the first exposure surface of the second bump electrode have mutually different shapes and sizes.

According to the present invention, a thin electronic component whose one substrate is omitted can be provided at a low cost. An electrode can be formed with higher precision than in the past because a bump electrode for which two-dimensional management with high precision is possible is used as an external terminal electrode. Also, an insulator layer is provided around the bump electrode and therefore, the bump electrode can be reinforced to prevent peeling of the bump electrode. Further, according to the present invention, to which of the first element and the second element the bump electrode is connected can easily be determined even if the circuit in the thin-film element layer is made asymmetric by the first and second elements with different electric characteristics and therefore, the orientation of mounting of an electronic component can easily be grasped from a bump electrode pattern.

In the present invention, it is preferable that both of the first and second bump electrodes have a second exposure surface exposed to an end face of the insulator layer. According to the configuration, the second exposure surface can be used as the formation surface of solder fillet.

In the present invention, the first element is a first spiral conductor composed of a plane coil pattern and it is preferable that the first bump electrode is connected to an internal peripheral end of the first spiral conductor and the second bump electrode is connected to an external peripheral end of the second spiral conductor. According to the configuration, an electronic component can be provided as a coil component.

According to the present invention, an electronic component that can be miniaturized, lowered, and manufactured at a low cost while securing desired filter performance can be provided.

BRIEF DESCRIPTION OF THE DRAWINGS

The above and other objects, features and advantages of this invention will become more apparent by reference to the following detailed description of the invention taken in conjunction with the accompanying drawings, wherein.

DETAILED DESCRIPTION OF THE EMBODIMENTS

Preferred embodiments of the present invention will be described in detail below with reference to the accompanying drawings.

Figure 1:
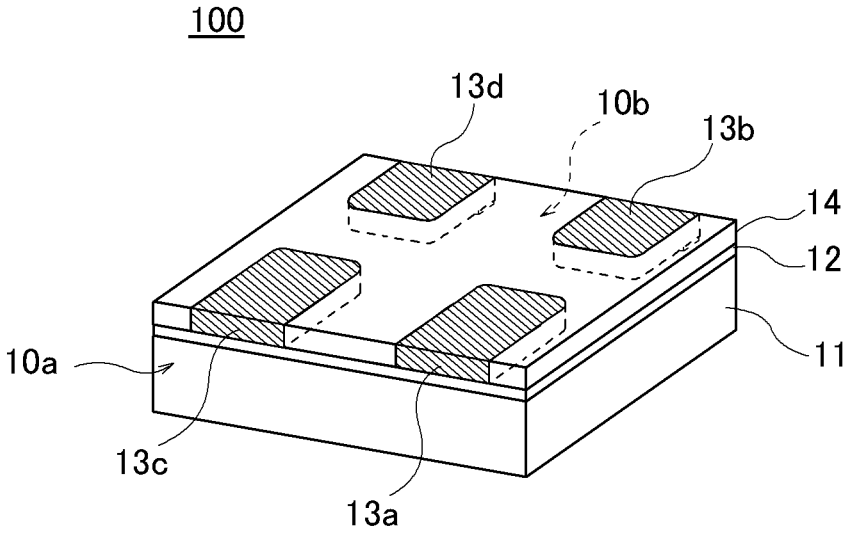
FIG. 1 is a schematic perspective view showing an appearance structure of a coil component 100 according to a first embodiment of the present invention.

FIG. 1 is a schematic perspective view showing an overview structure of the electronic component 100 according to the first embodiment of the present invention and shows a state in which a mounting surface is directed upward.

As shown in FIG. 1, the electronic component 100 according to the present embodiment is a common mode filter and includes a substrate 11, the thin-film element layer 12 containing a common mode filter element provided on one principal surface (top surface) of the substrate 11, first to fourth bump electrodes 13*a* to 13*d* provided on the principal surface (top surface) of the thin-film element layer 12, and an insulator layer 14 provided on the principal surface of the thin-film element layer 12 excluding formation positions of the bump electrodes 13*a* to 13*d*.

The electronic component 100 is a surface-mounted chip component in a shape of substantially rectangular parallelepiped and the first to fourth bump electrodes 13*a* to 13*d* are formed so as to be also exposed to an outer circumferential surface of a layered product composed of the substrate 11, the thin-film element layer 12, and the insulator layer 14. Of these bump electrodes, the first and third bump electrodes 13*a*, 13*c* are exposed from a first side face 10*a* parallel to the longitudinal direction of the layered product and the second and fourth bump electrodes 13*b*, 13*d* are exposed from a second side face 10*b* opposite to the first side face 10*a*. The electronic component 100 is turned upside down for mounting to be used with the side of the bump electrodes 13*a* to 13*d* directed in a downward direction. The plane shape and size of the first and third bump electrodes 13*a*, 13*c* exposed from the principal surface of the insulator layer 14 are different from the plane shape and size of the second and fourth bump electrodes 13*b*, 13*d* and particularly, the first and third bump electrodes 13*a*, 13*c* are larger than the second and fourth bump electrodes 13*b*, 13*d*. The first and third bump electrodes 13*a*, 13*c* have the same plane shape and size and the second and fourth bump electrodes 13*b*, 13*d* have the same plane shape and size. As will be described later, the bump electrodes 13*a* to 13*d* are thick-film plated electrodes formed by plating and Cu, Ag, Au and the like can be used therefore and Cu is preferably used.

The substrate 11 ensures mechanical strength of the electronic component 100 and also serves as a closed magnetic circuit of the common mode filter. A magnetic ceramic material, for example, sintered ferrite can be used as the material of the substrate 11. Though not particularly limited, when the chip size is 1.0×1.25×0.6 (mm), the thickness of the substrate 11 can be set to about 0.35 to 0.4 mM.

The thin-film element layer 12 is a layer containing a common mode filter element provided between the substrate 11 and the insulator layer 14. The thin-film element layer 12 has, as will be described in detail later, a multi-layered structure formed by an insulating layer and a conductor pattern being alternately stacked. Thus, the electronic component 100 according to the present embodiment is a so-called thin-film type coil component and is to be distinguished from a wire wound type having a structure in which a conductor wire is wound around a magnetic core.

The insulator layer 14 is a layer constituting a mounting surface (bottom face) of the electronic component 100 and protects the thin-film element layer 12 together with the substrate 11 and also serves as a closed magnetic circuit of the electronic component 100. However, mechanical strength of the insulator layer 14 is weaker than that of the substrate 11 and plays only a supplementary role in terms of strength. An epoxy resin (composite ferrite) containing ferrite powder can be used as the insulator layer 14. Though not particularly limited, when the chip size is 1.0×1.25×0.6 (mm), the thickness of the insulator layer 14 can be set to about 0.08 to 0.1 mm.

Figure 2:
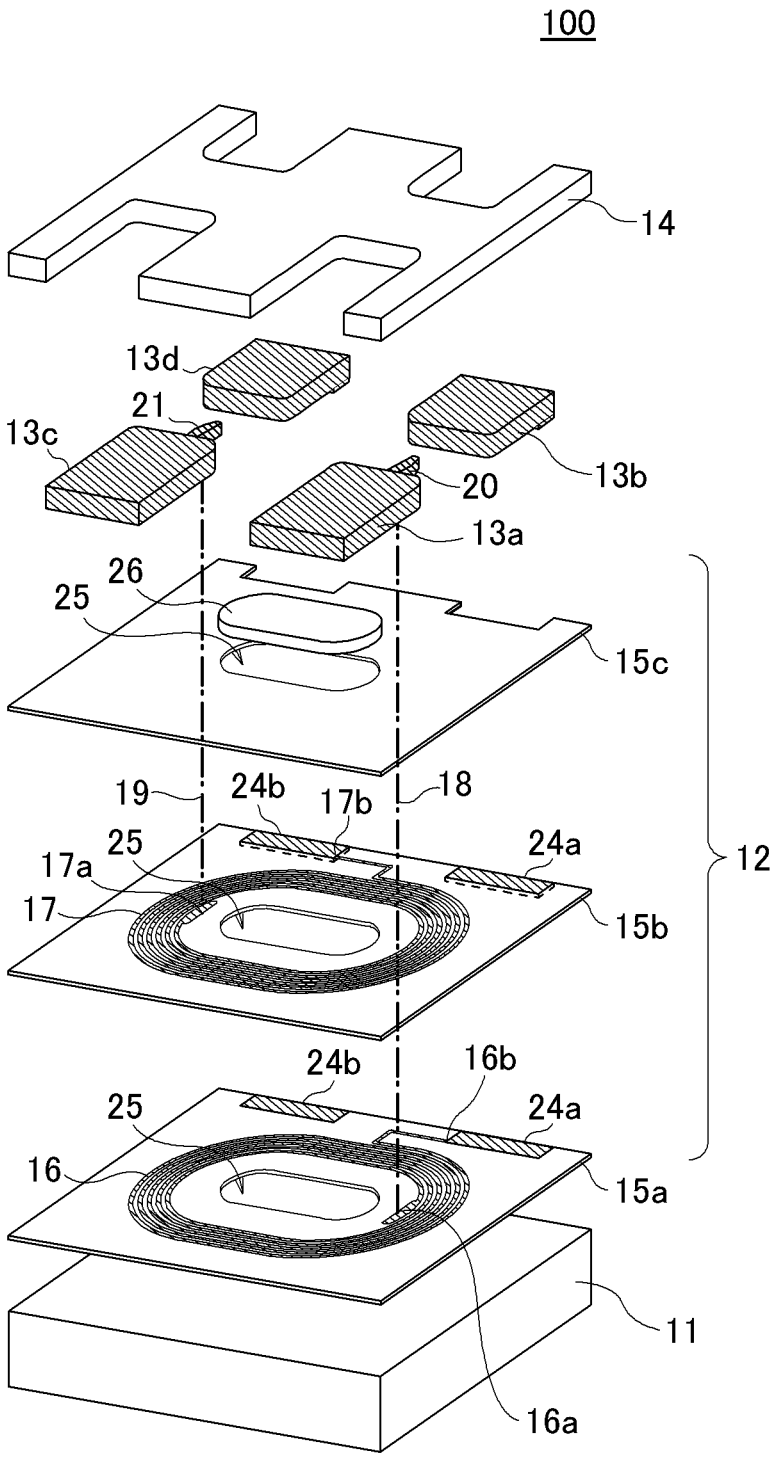
FIG. 2 is a schematic exploded perspective view showing a layer structure of the coil component 100 in detail.

FIG. 2 is a schematic exploded perspective view showing a layer structure of the electronic component 100 in detail.

As shown in FIG. 2, the thin-film element layer 12 includes first to third insulating layers 15*a* to 15*c* sequentially stacked from the substrate 11 side toward the insulator layer 14 side, a first spiral conductor 16 and terminal electrodes 24*a*, 24*b* formed on the first insulating layer 15*a*, a second spiral conductor 17 and the terminal electrodes 24*a*, 24*b* formed on the second insulating layer 15*b*. The number of insulating layers is still smaller than that in the conventional technology shown in FIG. 16.

The first to third insulating layers 15*a* to 15*c* insulate spiral conductor patterns provided in different layers and also serve to secure flatness of the plane on which spiral conductor patterns are formed. Particularly, the first insulating layer 15*a* serves to increase the accuracy of finishing spiral conductor patterns by absorbing unevenness of the surface of the substrate 11. It is preferable to use a resin excellent in electric and magnetic insulation properties and easy to work on as the material of the insulating layers 15*a* to 15*c* and though not particularly limited, a polyimide resin or epoxy resin can be used.

An internal peripheral end 16*a* of the first spiral conductor 16 is connected to a first lead conductor 20 and the first bump electrode 13*a* via a first contact hole 18 passing through the second and third insulating layers 15*b*, 15*c*. An external peripheral end 16*b* of the first spiral conductor 16 is connected to the first terminal electrode 24*a*.

An internal peripheral end 17*a* of the second spiral conductor 17 is connected to a second lead conductor 21 and the third bump electrode 13*c* via a second contact hole 19 passing through the third insulating layer 15*c*. An external peripheral end 17*b* of the second spiral conductor 17 is connected to the second terminal electrode 24*b*.

In the present embodiment, terminal electrodes connected to the internal peripheral ends 16*a*, 17*a* of the first and second spiral conductors 16, 17 are not provided on the first to third insulating layers 15*a* to 15*c*. This is because, as described above, the internal peripheral ends 16*a*, 17*a* of the first and second spiral conductors 16, 17 are connected to the first and third bump electrodes 13*a*, 13*c* via the first and second contact holes 18, 19 respectively without passing through end faces of the first to third insulating layers 15*a* to 15*c*. If terminal electrodes are formed on one side (side face 10*b* side in FIG. 1) of the first to third insulating layers 15*a* to 15*c*, a margin space without terminal electrode pattern is created on the opposite side (side face 10*a* side in FIG. 1) so that a coil arrangement region can be increased. Therefore, a DC resistance Rdc can be reduced by making the line width of the spiral conductors 16, 17 wider. Also, a common mode impedance Zc can be increased by increasing the number of turns of the spiral conductors 16, 17.

The first and the second spiral conductors 16, 17 have the same plane shape and are provided in the same position in plane view. The first and the second spiral conductors 16, 17 overlap completely and thus, strong magnetic coupling is generated between both conductors. With the above configuration, a conductor pattern in the thin-film element layer 12 constitutes a common mode filter.

The first and the second spiral conductors 16, 17 have both a circular spiral outer shape. A circular spiral conductor attenuates less at high frequencies and thus can be used preferably as a high-frequency inductance. The spiral conductors 16, 17 according to the present embodiment have an oblong shape, but may also have a complete round shape or elliptic shape. Alternatively, the spiral conductors 16, 17 may have a substantially rectangular shape. The above conductor patterns are formed by patterning using sputtering or plating and Cu, Ag, Au and the like can be used, but Cu is preferably used.

An opening 25 passing through the first to third insulating layers 15*a* to 15*c* is provided in the central region of the first to third insulating layers 15*a* to 15*c* and on the inner side of the first and second spiral conductors 16, 17 and a magnetic core 26 to form a magnetic circuit is formed inside the opening 25. It is preferable to use a magnetic powder containing resin (composite ferrite), which is the same material as that of the insulator layer 14, as the material of the magnetic core 26.

The first to fourth bump electrodes 13*a* to 13*d* and the first and second lead conductors 20, 21 are provided on the insulating layer 15*c* constituting the surface layer of the thin-film element layer 12. The second bump electrode 13*b* is connected to the terminal electrode 24*a* and the fourth bump electrode 13*d* is connected to the terminal electrode 24*b*. The "bump electrode" herein means, in contrast to an electrode formed by thermally compressing a metal ball of Cu, Au or the like using a flip chip bonder, a thick-film plated electrode formed by plating. The thickness of the bump electrode is equal to the thickness of the insulator layer 14 or more and can be set to about 0.08 to 0.1 mm. That is, the thickness of the bump electrodes 13*a* to 13*d* is thicker than a conductor pattern in the thin-film element layer 12 and particularly has a thickness five times or more than a spiral conductor pattern in the thin-film element layer 12.

In the present embodiment, the first and second lead conductors 20, 21 are formed on the surface of the third insulating layer 15*c* of the thin-film element layer 12 together with the first to fourth bump electrodes 13*a* to 13*d*. The first lead conductor 20 is provided integrally in the same layer as the first bump electrode 13*a* and the third lead conductor 21 is provided integrally in the same layer as the third bump electrode 13*c*. Therefore, one layer of the dedicated insulating layer 2*d* to form the first and second lead conductors 8*a*, 8*b* provided in the conventional coil component shown in FIG. 16 can be omitted so that a still thinner coil component can be provided at a low cost.

The insulator layer 14 is formed on the third insulating layer 15*c* on which the first to fourth bump electrodes 13*a* to 13*d* and the first and second lead conductors 20, 21 are formed. The insulator layer 14 is provided like filling in surroundings of the bump electrodes 13*a* to 13*d*. The first and second lead conductors 20, 21 are lower than the bump electrodes 13*a*, 13*c* and thus are buried under the insulator layer 14 and are not exposed to the surface. Therefore, a good-looking terminal electrode pattern can be provided. Incidentally, the first and second lead conductors 20, 21 may be made as high as the bump electrodes 13*a* to 13*d* and in that case, the lead conductors 20, 21 are also exposed together with the bump electrodes 13*a* to 13*d*. Even with such a configuration, however, no short-circuit between bump electrodes, causing no practical problem.

Each of the bump electrodes 13*a* to 13*d* has a first exposure surface (principal surface/upper surface) exposed to the principal surface side of the insulator layer 14 and a second exposure surface (end face/side face) exposed to the end face (outer circumferential surface) side of the insulator layer 14. Particularly, the second exposure surface of each of the bump electrodes 13*a* to 13*d* functions as a formation surface of a solder fillet during mounting. The plane shape and size of the first and third bump electrodes 13*a*, 13*c* exposed from the principal surface of the insulator layer 14 are different from the plane shape and size of the second and fourth bump electrodes 13*b*, 13*d* and particularly, the first and third bump electrodes 13*a*, 13*c* are larger than the second and fourth bump electrodes 13*b*, 13*d*. The first and third bump electrodes 13*a*, 13*c* have the same plane shape and size and the second and fourth bump electrodes 13*b*, 13*d* have the same plane shape and size. Therefore, a terminal electrode pattern whose orientation of mounting can visually be recognized can be provided.

Figure 3:
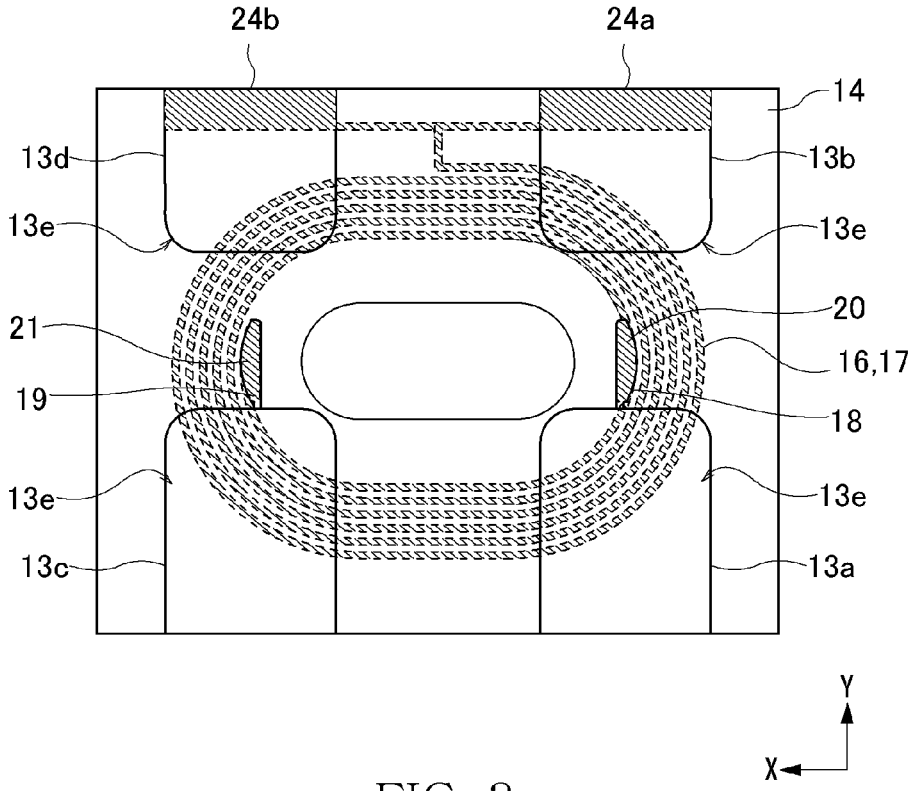
FIG. 3 is a schematic plan view showing a spatial relationship between a conductor pattern in the thin-film coil layer 12 and the bump electrodes 13*a* to 13*d;*

FIG. 3 is a schematic plan view showing a spatial relationship between a pattern of the spiral conductors 16, 17 in the thin-film element layer 12 and the bump electrodes 13*a* to 13*d*.

As shown in FIG. 3, the first and the second spiral conductors 16, 17 both form a plane spiral counterclockwise from the internal peripheral end toward the external peripheral end and overlap completely in plane view and thus, strong magnetic coupling is generated between both conductors. Also in the present embodiment, a part of the first to fourth bump electrodes 13*a* to 13*d* overlaps with the spiral conductors 16, 17. It is necessary to secure a certain level of area on the mounting surface side of the bump electrodes 13*a* to 13*d* to ensure soldering to a printed board and if the bump electrodes 13*a* to 13*d* are arranged so as to overlap with the spiral conductors 16, 17, the electrode area can be secured without increasing the chip area. It is also possible to configure so that the bump electrodes 13*a* to 13*d* do not overlap with the spiral conductors 16, 17, but in that case, chip components will become larger.

A side face 13*e* of the bump electrodes 13*a* to 13*d* in contact with the insulator layer 14 preferably has, as illustrated in FIG. 3, a curved shape without edges. As will be described in detail later, after the bump electrodes 13 are formed, the insulator layer 14 is formed by pouring a paste of composite ferrite and if, at this point, the side face 13*e* of the bump electrodes 13*a* to 13*d* has an edged corner, surroundings of the bump electrodes are not completely packed with the paste and bubbles are more likely to be contained. However, if the side faces of the bump electrodes 13*a* to 13*d* are curved, a fluid resin reaches every corner so that a closely packed insulator layer 14 containing no bubbles can be formed. Moreover, adhesiveness between the insulator layer 14 and the bump electrodes 13*a* to 13*d* is increased so that reinforcement for the bump electrodes 13*a* to 13*d* can be increased.

In the present embodiment, the length in the Y direction of the first and third bump electrodes 13*a*, 13*c* is longer than the length of the second and fourth bump electrodes 13*b*, 13*d*. The first and third bump electrodes 13*a*, 13*c* are connected to the contact holes 18, 19 via the lead conductors 20, 21 respectively and the distance from the contact holes 18, 19 to the bump electrodes 13*a*, 13*c* is short and thus, the lead conductors 20, 21 are very short. Incidentally, conductor portions projecting to above the contact holes 18, 19 are contained in the lead conductors 20, 21. Thus, the first and third bump electrodes 13*a*, 13*c* connected to the internal peripheral ends 16*a*, 17*a* side of the first and second spiral conductors 16, 17 and the second and fourth bump electrodes 13*b*, 13*d* connected to the external peripheral ends 16*b*, 17*b* side of the first and second spiral conductors 16, 17 have mutually different shapes and sizes so that the orientation of the electronic component 100 can easily be grasped.

Figure 4:
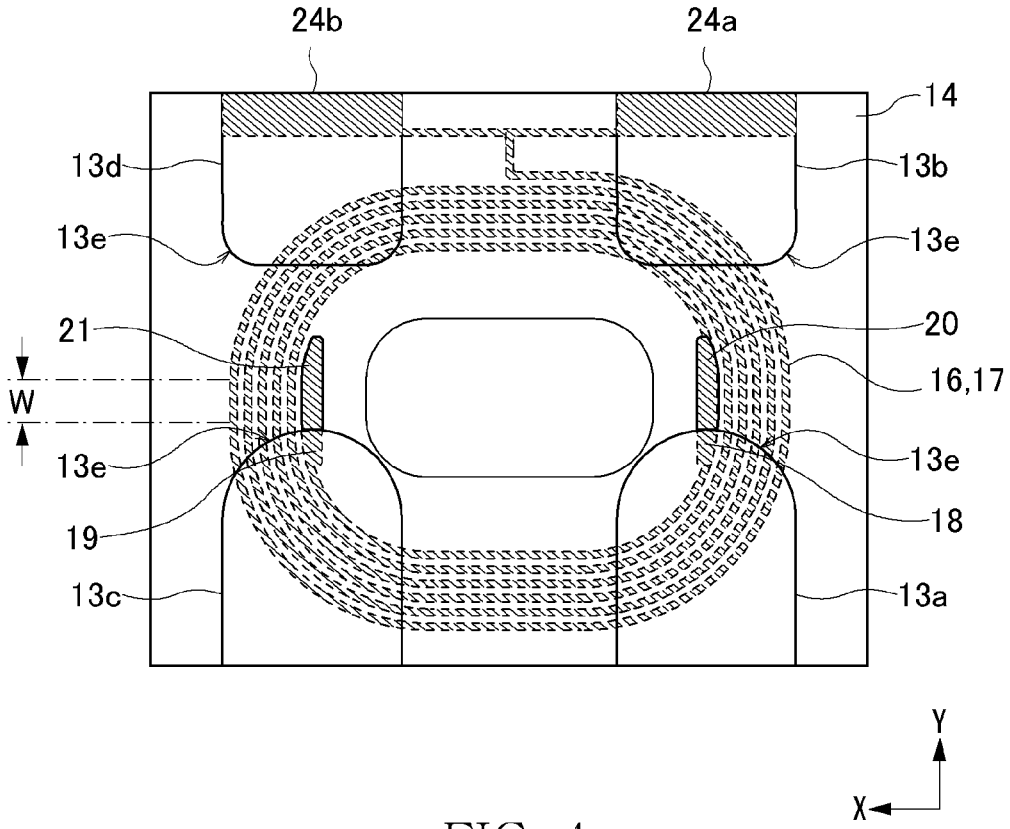
FIG. 4 is a schematic plan view showing a modification of the spiral conductor pattern.

FIG. 4 is a schematic plan view showing a modification of the spiral conductor pattern.

As shown in FIG. 4, the spiral conductors 16, 17 are characterized in that the loop size is enlarged in the Y direction by a width W. Accordingly, the area of the magnetic core 26 is increased. On the other hand, contact with the magnetic core 26 is avoided by increasing the curvature of the side face 13*e* of the bump electrodes 13*a*, 13*c*. If, as described above, the terminal electrodes connected to the internal peripheral ends 16*a*, 17*a* of the first and second spiral conductors 16, 17 are omitted, a margin space is created in a region opposite to the terminal electrodes 24*a*, 24*b* and thus, like in the present embodiment, the loop size of the spiral conductor can be increased and also the cross section of the magnetic core 26 can be increased. Therefore, the common mode impedance Zc can be increased.

As described above, the electronic component 100 according to the present embodiment is provided with the substrate 11 only on one side of the thin-film element layer 12 and the substrate on the other side is omitted and instead, the insulator layer 14 is provided so that a thin-film chip component can be provided at a low cost. Also, by providing the bump electrodes 13*a* to 13*d* that are as thick as the insulator layer 14, a process to form an external electrode surface on the side face or the upper or lower surface of a chip component can be omitted so that an external electrode can be formed easily with high precision.

Also, the electronic component 100 according to the present embodiment has the first and third bump electrodes 13*a*, 13*c* exposed to the surface of the insulator layer 14 formed larger than the second and fourth bump electrodes 13*b*, 13*d* and therefore, a terminal electrode pattern whose orientation of mounting can visually be recognized can be provided.

Further, in the electronic component 100 according to the present embodiment, the lead conductors 20, 21 are formed on the surface of the thin-film element layer 12 together with the bump electrodes 13*a* to 13*d*, the first lead conductor 20 is provided integrally in the same layer as the first bump electrode 13*a*, and the third lead conductor 21 is provided integrally in the same layer as the third bump electrode 13*c* and therefore, still thinner coil components can be provided. The distance between the insulator layer 14 and the thin-film element layer 12 is brought closer to each other with the omission of an insulating layer needed to form the first and second lead conductors 20, 21 in the thin-film element layer so that the common mode impedance can be increased. Further, material costs and man-hours are reduced with the omission of a dedicated insulating layer and an independent lead conductor and therefore, electronic components that can be manufactured at a low cost can be provided.

Next, a method of manufacturing the electronic component 100 will be described in detail.

Figure 5:
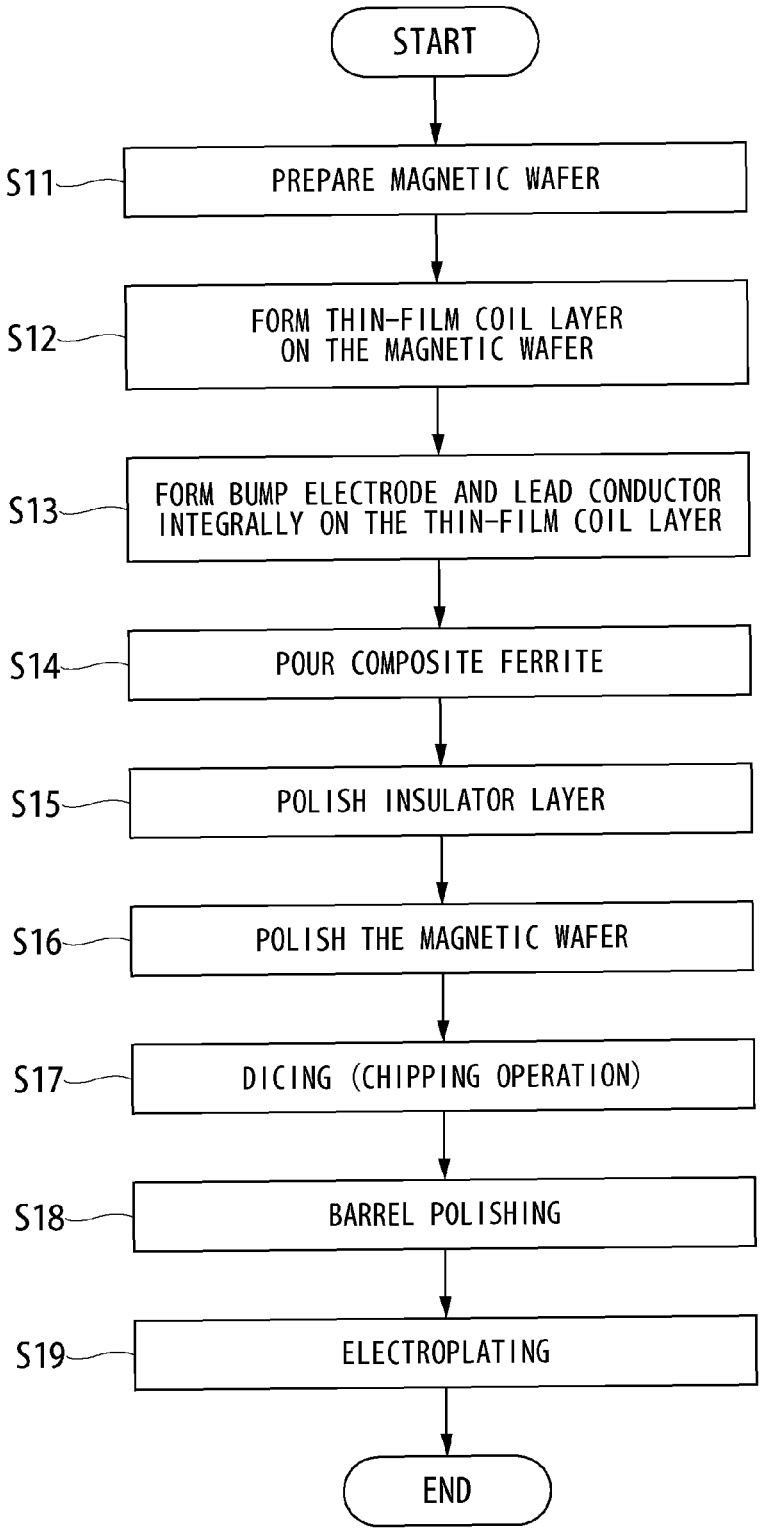
FIG. 5 is a flow chart showing a manufacturing method of the electronic component 100.
Figure 6:
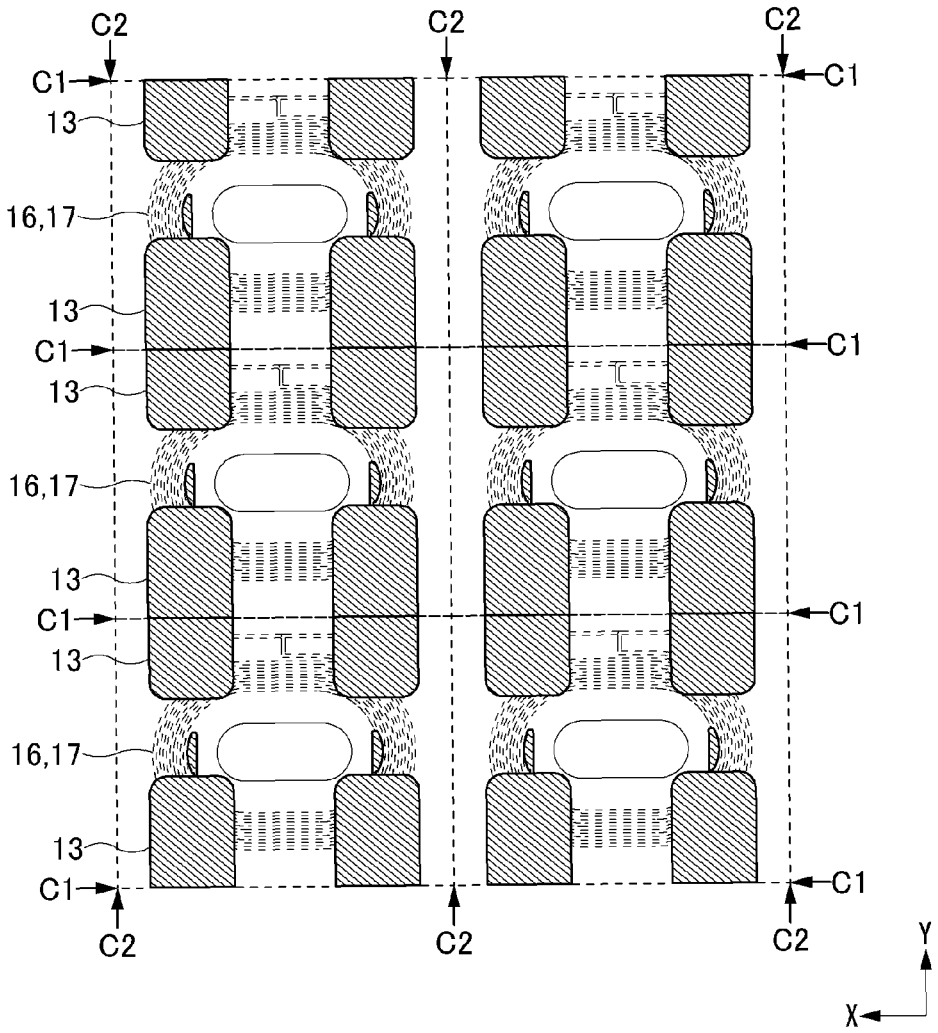
FIG. 6 is a schematic plan view showing the configuration of a magnetic wafer on which a large number of the electronic components 100 are formed.

FIG. 5 is a flow chart showing a manufacturing method of the electronic component 100. FIG. 6 is a schematic plan view showing the configuration of a magnetic wafer on which a large number of the electronic components 100 are formed. Further, FIGS. 7A to 7E are schematic cross-sectional views illustrating formation processes of the bump electrodes 13*a*, 13*c* and the lead conductors 20, 21.

As shown in FIGS. 5 and 6, a mass-production process is performed for the manufacture of the electronic component 100 in which a large number of common mode filter elements (coil conductor pattern) are formed on a large magnetic substrate (magnetic wafer) and then each element is individually cut to manufacture a large number of chip components. Thus, first a magnetic wafer is prepared (step S11) and the thin-film element layer 12 on which a large number of common mode filter elements are laid out on the surface of the magnetic wafer is formed (step S12).

The thin-film element layer 12 is formed by the so-called thin-film technology. The thin-film technology is a method by which a multilayer film in which an insulating film and a conductor layer are alternately formed is formed by repeating a process of applying a photosensitive resin to form the insulating layer by exposure and development thereof and then forming the conductor pattern on the surface of the insulating layer. The formation process of the thin-film element layer 12 will be described in detail below.

In the formation of the thin-film coil layer 12, the insulating layer 15*a* is first formed and then, the first spiral conductor 16 and the terminal electrodes 24*a* to 24*d* are formed on the insulating layer 15*a*. Next, after the insulating layer 15*b* being formed on the insulating layer 15*a*, the second spiral conductor 17 and the terminal electrodes 24*a* to 24*d* are formed on the insulating layer 15*b* and further, the insulating layer 15*c* is formed on the insulating layer 15*b* (see FIG. 2).

Each of the insulating layers 15*a* to 15*c* can be formed by spin-coating the substrate surface with a photosensitive resin and exposing and developing the substrate surface. Particularly, a through-hole to form the opening 25 and the contact hole conductor 18 and openings corresponding to the terminal electrodes 24*a*, 24*b* are formed in the second insulating layer 15*b* and a through-hole to form the opening and the contact hole conductors 18, 19 and openings corresponding to the terminal electrodes 24*a*, 24*b* are formed in the third insulating layer 15*c*. Cu or the like can be used as the material of conductor patterns, which can be formed by forming a conductor layer by the vapor deposition or sputtering and then forming a patterned resist layer thereon and performing electroplating before the resist layer is removed.

Figure 7A:
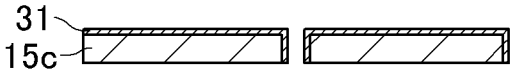
FIGS. 7A to 7E are schematic sectional views illustrating formation processes of the bump electrodes 13*a*, 13*c* and the lead conductors 20, 21.
Figure 7B:
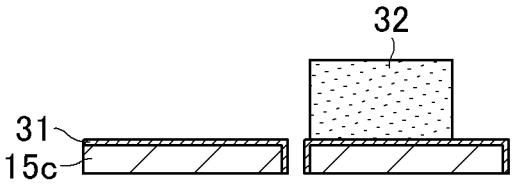

Next, the bump electrodes 13*a* to 13*d* and the first and second lead conductors 20, 21 are formed on the insulating layer 15*c*, which is the surface layer of the thin-film element layer 12. As the formation method of the bump electrodes 13*a* to 13*d*, as shown in FIG. 7A, abase conductive film 31 is first formed on the entire surface of the insulting layer 15*c* by sputtering. Cu or the like can be used as the material of the base conductive film 31. Then, as shown in FIG. 7B, a dry film is pasted and then the dry film in positions where the bump electrodes 13*a* to 13*d* and the first and second lead conductors 20, 21 should be formed is selectively removed by exposure and development to form a dry film layer 32 and to expose the base conductive film 31.

Figure 7C:
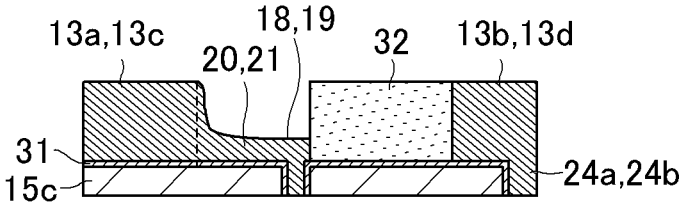

Next, as shown in FIG. 7C, electroplating is performed and exposed portions of the base conductive film 31 are grown to form the thick bump electrodes 13*a* to 13*d*. At this point, the through hole to form the contact hole conductors 18, 19 is filled with a plating material and the contact hole conductors 18, 19 are thereby formed. The openings to form the terminal electrodes 24*a*, 24*b* are also filled with a plating material and the terminal electrodes 24*a*, 24*b* are thereby formed. Further, the first and second lead conductors 20, are grown by plating, but plating growth thereof is incomplete because the line width of plating growth surface is narrow when compared with the bump electrodes 13*a* to 13*d* and the height thereof is lower than the bump electrodes 13*a* to 13*d*. The height of the first and second lead conductors 20, 21 changes a little depending on the position thereof and increases as the bump electrode is approached, but the average height is about 30 to 50% of the height of the bump electrode. The height of the lead conductors 20, 21 can intentionally be brought closer to the height of the bump electrodes 13*a* to 13*d* by adjusting plating conditions, but in the present embodiment, such control is not needed.

Figure 7D:
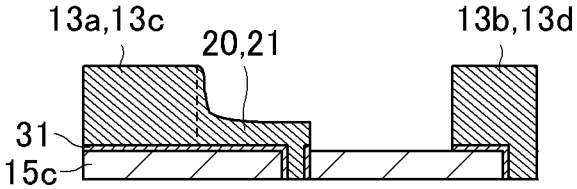

Then, as shown in FIG. 7D, the dry film layer 32 is removed and the unnecessary base conductive film 31 is removed by etching the entire surface to complete the bump electrodes 13*a* to 13*d* in a substantially columnar shape and the first and second lead conductors 20, 21. At this point, as shown in FIG. 6, the bump electrode 13 in a substantially columnar shape is formed as an electrode common to two chip components adjacent to each other in the illustrated Y direction. The bump electrode 13 is divided into two by dicing described later and the individual bump electrodes 13*a* to 13*d* corresponding to each element are thereby formed.

Figure 7E:
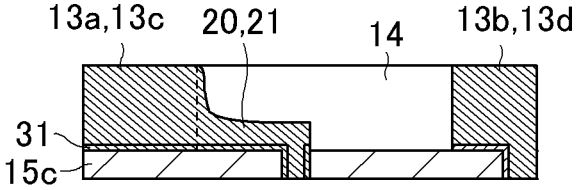

Next, as shown in FIG. 7E, a paste of composite ferrite is poured onto the magnetic wafer on which the bump electrode 13 is formed and cured to form the insulator layer 14 (step S14). At this point, a large amount of paste is poured to reliably form the insulator layer 14, thereby burying the bump electrodes 13*a* to 13*d* and the lead conductors 20, 21 under the insulator layer 14. Thus, the insulator layer 14 is polished until the upper surface of the bump electrodes 13*a* to 13*d* is exposed to have a predetermined thickness and also to make the surface thereof smooth (step S15). Further, the magnetic wafer is also polished to have a predetermined thickness (step S16).

The bump electrodes 13*a* to 13*d* are exposed by polishing of the insulator layer 14, but as described above, the first and second lead conductors 20, 21 are lower than the bump electrodes 13*a* to 13*d* and so, as shown in FIG. 7E, remain buried under the insulator layer 14 without being exposed to the surface thereof. Thus, in the present embodiment, only the bump electrodes 13*a* to 13*d* are exposed to the surface of the insulator layer 14 and therefore, a good-looking terminal electrode pattern as in the past can be provided.

Next, each common mode filter element is individualized (formed into chips) by dicing of the magnetic wafer to produce the chip component shown in FIG. 2 (step S17). In this case, as shown in FIG. 6, of a cutting line C1 extending in the X direction and a cutting line C2 extending in the Y direction, the cutting line C1 passes through the center of the bump electrode 13 and the obtained cut surface of the bump electrodes 13*a* to 13*d* is exposed to the side face of the electronic component 100. Side faces of the bump electrodes 13*a* to 13*d* become a formation surface of a solder fillet during mounting and thus, fixing strength during soldering can be increased.

Next, after edges being removed by performing barrel polishing of chip components (step S18), electroplating is performed (step S19) to form a smooth electrode surface completely integrating the terminal electrodes 24*a*, 24*b* and the bump electrodes 13*b*, 13*d* exposed to the side face 10*b* side of the thin-film element layer 12, thereby completing the bump electrodes 13*a* to 13*d* shown in FIG. 1. By performing barrel polishing of the outer surface of chip components as described above, electronic components resistant to damage such as chipping can be manufactured. The surface of the bump electrodes 13*a* to 13*d* exposed on an outer circumferential surface of chip components is plated and thus, the surface of the bump electrodes 13*a* to 13*d* can be made a smooth surface.

According to the manufacturing method of the electronic component 100 in the present embodiment, as described above, one of upper and lower magnetic substrates used traditionally is omitted and instead, the insulator layer 14 is formed and therefore, electronic components can be manufactured easily at a low cost. Moreover, the insulator layer 14 is formed around the bump electrodes 13*a* to 13*d* and therefore, the bump electrodes 13*a* to 13*d* can be reinforced to prevent peeling of the bump electrodes 13*a* to 13*d* or the like. Also, according to the manufacturing method of the electronic component 100 in the present embodiment, the bump electrodes 13*a* to 13*d* are formed by plating and therefore, compared with formation by, for example, sputtering, an external terminal electrode whose accuracy of finishing is higher and which is more stable can be provided. Further, according to the manufacturing method of the electronic component 100 in the present embodiment, the lead conductors 20, 21 and the bump electrodes 13*a* to 13*d* are formed on the same plane by electroplating at a time and therefore, costs can be reduced by decreasing man-hours. The plane shape and size of the first and third bump electrodes 13*a*, 13*c* exposed from the principal surface of the insulator layer 14 are different from the plane shape and size of the second and fourth bump electrodes 13*b*, 13*d* and particularly, the first and third bump electrodes 13*a*, 13*c* are larger than the second and fourth bump electrodes 13*b*, 13*d*. The first and third bump electrodes 13*a*, 13*c* have the same plane shape and size and the second and fourth bump electrodes 13*b*, 13*d* have the same plane shape and size. Therefore, a terminal electrode pattern whose orientation of mounting can visually be recognized can be provided.

Figure 8:
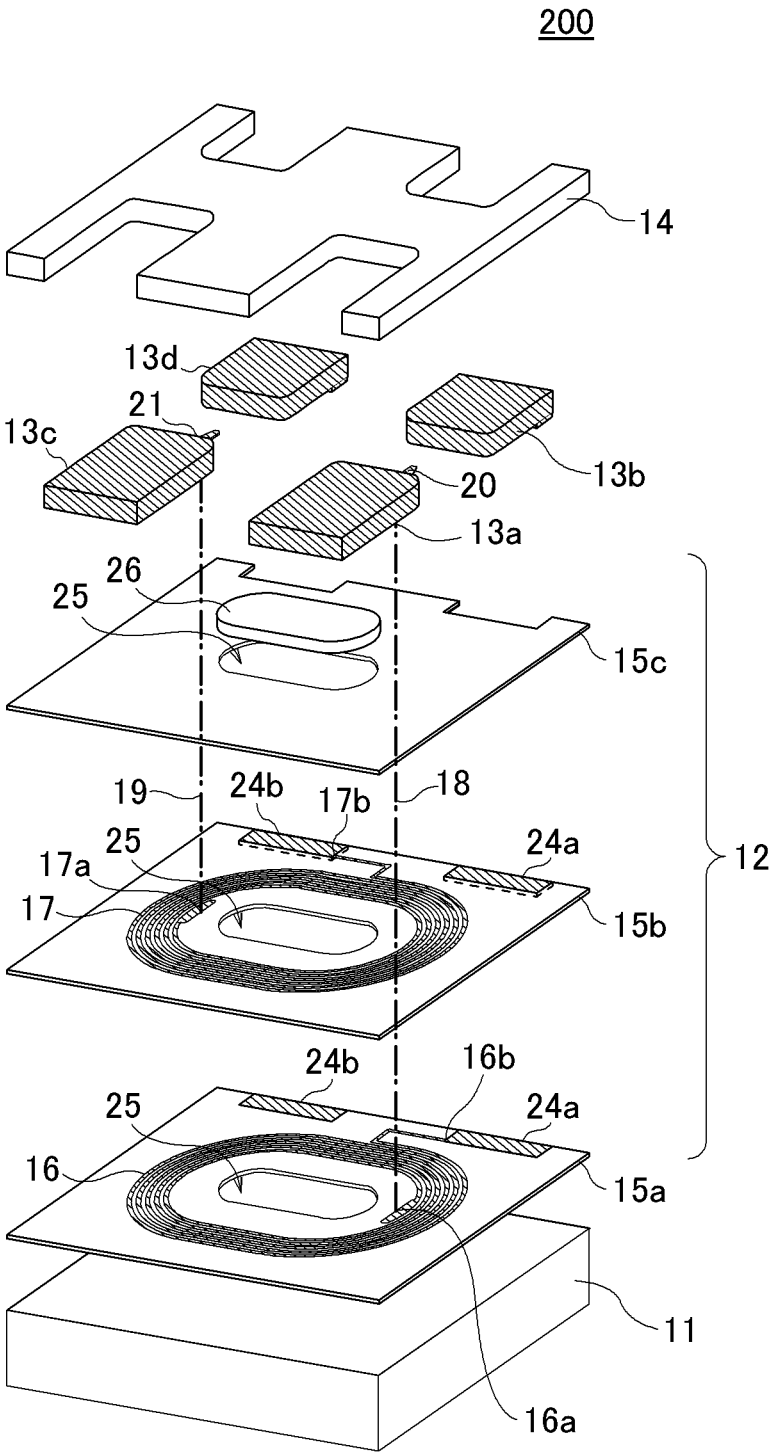
FIG. 8 is a schematic exploded perspective view showing a layer structure of an electronic component 200 according to the second embodiment of the present invention.
Figure 9:
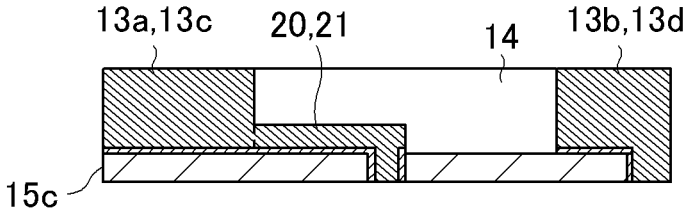
FIG. 9 is a schematic sectional view showing the structure of the bump electrode and the lead conductor.

FIG. 8 is a schematic exploded perspective view showing a layer structure of an electronic component 200 according to the second embodiment of the present invention. FIG. 9 is a schematic sectional view showing the structure of the bump electrode and the lead conductor.

As shown in FIGS. 8 and 9, the electronic component 200 is characterized in that the height (thickness) of the first and second lead conductors 20, 21 is rapidly lowered in a boundary with the bump electrodes 13*a* to 13*d*. The other configuration is substantially the same as the configuration of the electronic component 100 according to the first embodiment and the same reference numerals are attached to the same elements and a detailed description thereof is omitted.

According to the electronic component 200 in the present embodiment, in addition to the effects of the invention by the electronic component 100, only the bump electrodes 13*a* to 13*d* can reliably be exposed from the bottom face of a chip component and the first and second lead conductors 20, 21 can reliably be buried under the insulator layer 14.

FIGS. 10A to 10G are a schematic sectional views illustrating formation processes of the bump electrodes and the lead conductors. The manufacturing method of the electronic component 200 will be described in detail below with reference to the flow chart in FIG. 5 along with FIGS. 10A to 10G.

In the manufacture of the electronic component 200, first a magnetic wafer is prepared (step S11) and the thin-film element layer 12 on which a large number of common mode filter elements are laid out on the surface of the magnetic wafer is formed. This is substantially the same as the electronic component 100 according to the first embodiment and thus, a detailed description thereof is omitted.

Figure 10A:
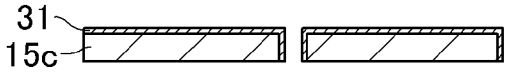
FIGS. 10A to 10G are schematic sectional views illustrating formation processes of the bump electrodes and the lead conductors.
Figure 10B:
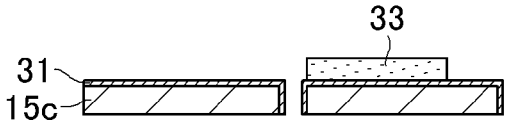

Next, the bump electrodes 13*a* to 13*d* and the first and second lead conductors 20, 21 are formed on the insulating layer 15*c* (step S13). As the formation method of the bump electrodes 13*a* to 13*d*, as shown in FIG. 10A, the base conductive film 31 is first formed on the entire surface of the insulting layer 15*c* by sputtering. Then, as shown in FIG. 10B, a photoresist is applied and then the photoresist in positions where the bump electrodes 13*a* to 13*d* and the first and second lead conductors 20, 21 should be formed is selectively removed by exposure and development to form a photoresist layer 33 and to expose the base conductive film 31.

Figure 10C:
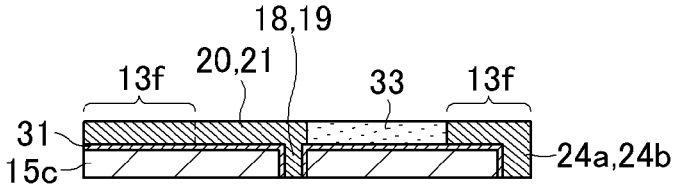

Next, as shown in FIG. 10C, the first electroplating is performed to grow an exposed portion of the base conductive film 31 to a thickness appropriate for the first and second lead conductors 20, 21. At this point, the through hole to form the contact hole conductors 18, 19 is filled with a conductive film and the contact hole conductors 18, 19 are thereby formed. The openings to form the terminal electrodes 24*a*, 24*b* are also filled with a plating material and the terminal electrodes 24*a*, 24*b* are thereby formed. Further, lower portions 13*f* of the bump electrodes are formed in formation positions of the bump electrodes 13*a* to 13*d*.

Figure 10D:
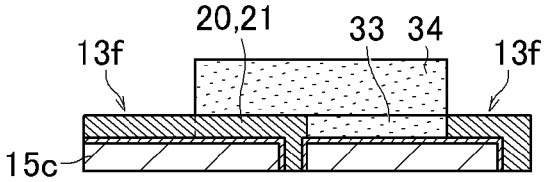

Then, as shown in FIG. 10D, a dry film is pasted and then the dry film in positions where the bump electrodes 13*a* to 13*d* and the first and second lead conductors 20, 21 should be formed is selectively removed by exposure and development to form a dry film layer 34 and to expose the lower portions 13*f* of the bump electrodes 13*a* to 13*d* grown by plating up to a thickness appropriate for the lead conductors 20, 21.

Figure 10E:
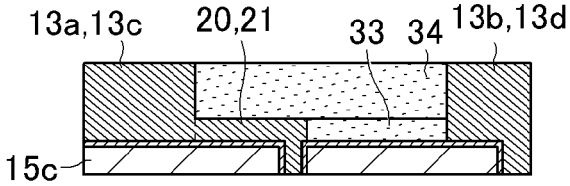

Next, as shown in FIG. 10E, the second electroplating is performed to further grow the lower portions 13*f* of the bump electrodes 13*a* to 13*d* to form the thick bump electrodes 13*a* to 13*d*. At this point, the lead conductors 20, 21 are covered with the dry film layer 34 and do not grow by plating.

Figure 10F:
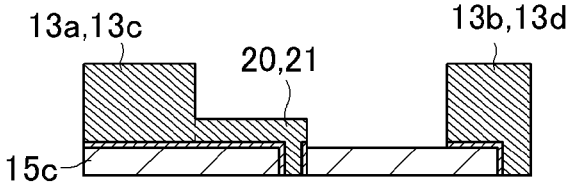

Then, as shown in FIG. 10F, the dry film layer 34 and the photoresist layer 33 are removed and the unnecessary base conductive film 31 is removed by etching the entire surface to complete the bump electrodes 13*a* to 13*d* in a substantially columnar shape and the first and second lead conductors 20, 21.

Figure 10G:
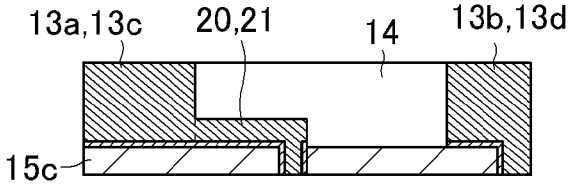

Next, as shown in FIG. 10G, a paste of composite ferrite is poured onto the magnetic wafer on which the bump electrodes 13*a* to 13*d* and lead conductors 20, 21 are formed and cured to form the insulator layer 14 (step S14). At this point, a large amount of paste is poured to reliably form the insulator layer 14, thereby burying the bump electrodes 13*a* to 13*d* and the lead conductors 20, 21 under the insulator layer 14. Thus, the insulator layer 14 is polished until the upper surface of the bump electrodes 13*a* to 13*d* is exposed to have a predetermined thickness and also to make the surface thereof smooth (step S15). Further, the magnetic wafer is also polished to have a predetermined thickness (step S16).

The bump electrodes 13*a* to 13*d* are exposed by polishing of the insulator layer 14, but as described above, the first and second lead conductors 20, 21 are certainly lower than the bump electrodes and so remain buried under the insulator layer 14 without being exposed to the surface thereof. Thus, in the present embodiment, only the bump electrodes 13*a* to 13*d* are exposed to the surface of the insulator layer 14 and therefore, a good-looking terminal electrode pattern as in the past can be provided.

Then, each common mode filter element is individualized (formed chips) by dicing of the magnetic wafer to produce the chip component shown in FIG. 8 (step S17). Further, after edges being removed by performing barrel polishing of chip components (step S18), electroplating is performed (step S19) to form a smooth electrode surface completely integrating the terminal electrodes 24*a*, 24*b* and the bump electrodes 13*b*, 13*d* exposed to the side face 10*b* side of the thin-film element layer 12, thereby completing the bump electrodes 13*a* to 13*d* shown in FIG. 8.

According to the manufacturing method of the electronic component 200 in the present embodiment, as described above, the electroplating process is divided into two processes and the height of the lead conductors 20, 21 are made significantly different from the height of the bump electrodes 13*a* to 13*d* and therefore, only the lead conductors 20, 21 can reliably be buried under the insulator layer 14 while the bump electrodes 13*a* to 13*d* being exposed and electronic components having a good-looking terminal electrode pattern can reliably be manufactured. The plane shape and size of the first and third bump electrodes 13*a*, 13*c* exposed from the principal surface of the insulator layer 14 are different from the plane shape and size of the second and fourth bump electrodes 13*b*, 13*d* and particularly, the first and third bump electrodes 13*a*, 13*c* are larger than the second and fourth bump electrodes 13*b*, 13*d*. The first and third bump electrodes 13*a*, 13*c* have the same plane shape and size and the second and fourth bump electrodes 13*b*, 13*d* have the same plane shape and size. Therefore, a terminal electrode pattern whose orientation of mounting can visually be recognized can be provided.

Figure 11:
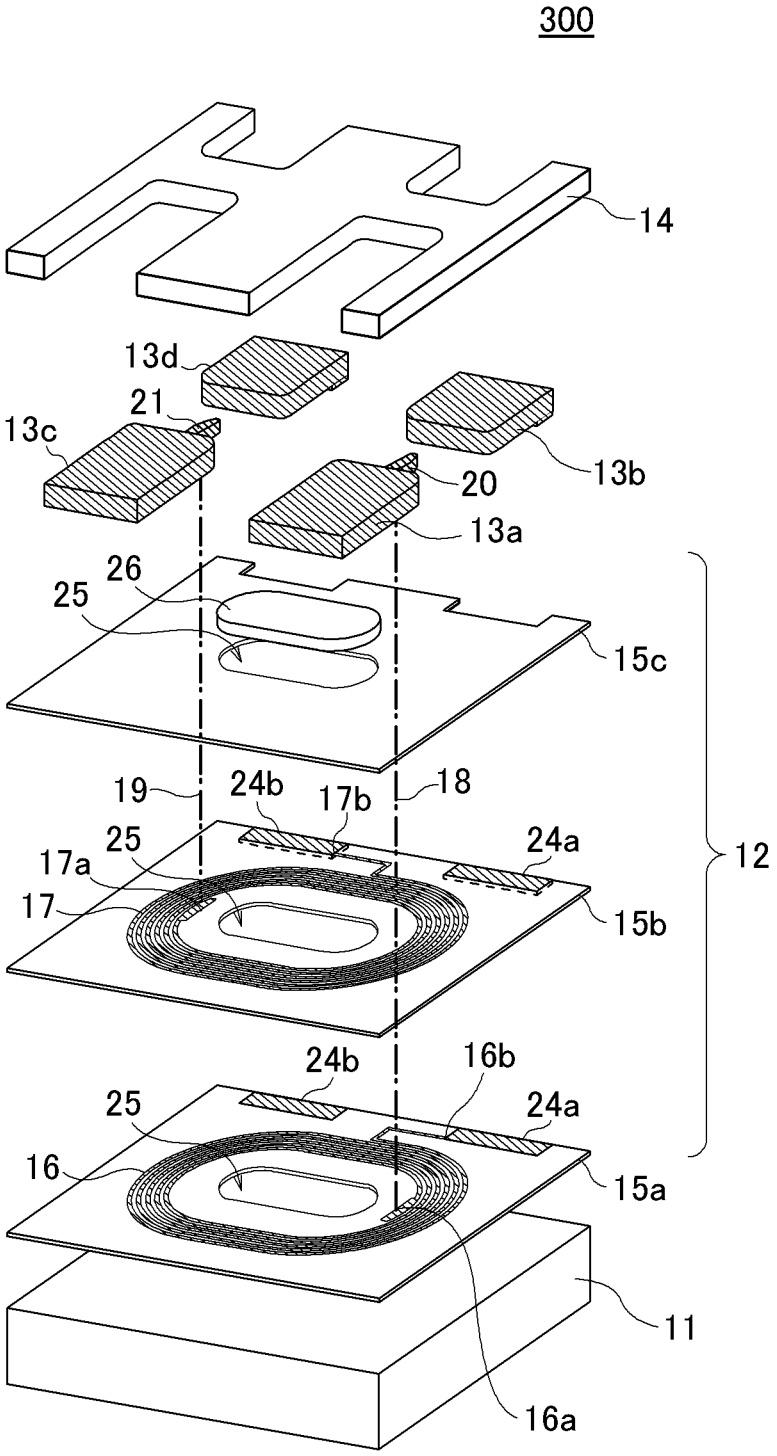
FIG. 11 is a schematic exploded perspective view showing the layer structure of an electronic component 300 according to the third embodiment of the present invention.
Figure 12:
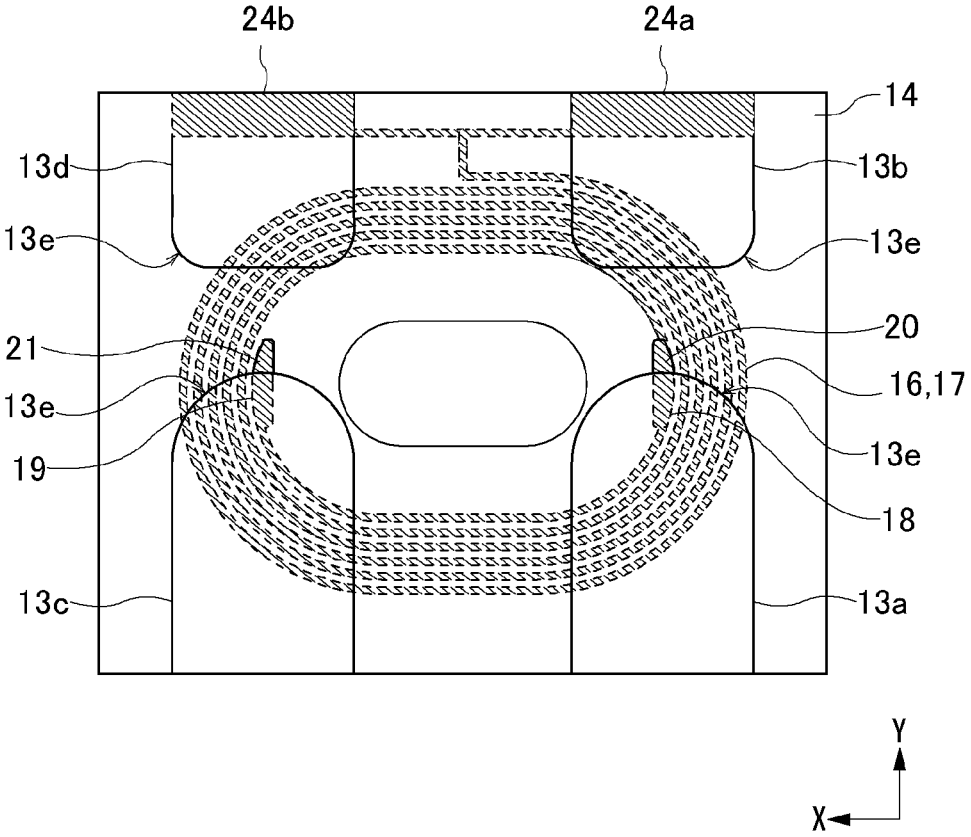
FIG. 12 is a schematic plan view showing the spatial relationship between a pattern of the spiral conductors 16, 17 in the thin-film element layer 12 and the bump electrodes 13*a* to 13*d;*

FIG. 11 is a schematic exploded perspective view showing the layer structure of an electronic component 300 according to the third embodiment of the present invention. FIG. 12 is a schematic plan view showing the spatial relationship between a pattern of the spiral conductors 16, 17 in the thin-film element layer 12 and the bump electrodes 13*a* to 13*d*.

As shown in FIGS. 11 and 12, the electronic component 300 is characterized in that the first and third bump electrodes 13*a*, 13*c* are still larger. Particularly the first bump electrode 13*a* has a portion overlapping with the first contact hole conductor 18 connected to the internal peripheral end 16*a* of the first spiral conductor 16 bypassing through the insulating layer 15*c* in plane view and the third bump electrode 13*c* has a portion overlapping with the second contact hole conductor 19 connected to the internal peripheral end 17*a* of the second spiral conductor 17 bypassing through the insulating layer 15*c* in plane view. As a result, the first and third bump electrodes 13*a*, 13*c* are directly connected to the contact hole conductors 18, 19 respectively without practically passing through the lead conductors 20, 21. The other configuration is substantially the same as the configuration of the electronic component 100 according to the first embodiment and the same reference numerals are attached to the same elements and a detailed description thereof is omitted.

Thus, in the present embodiment, the first bump electrode 13*a* has a portion overlapping with the first contact hole conductor 18 in plane view and the third bump electrode 13*c* has a portion overlapping with the second contact hole conductor 19 in plane view and therefore, the first and third bump electrodes 13*a*, 13*c* can directly be connected to the contact hole conductors 18, 19 and the lead conductors 20, 21 can practically be omitted. Moreover, the bump electrodes 13*a*, 13*c* on one side and the bump electrodes 13*b*, 13*d* on the other side have mutually different sizes and therefore, electronic components having a terminal electrode pattern whose orientation of mounting can visually be recognized can be provided.

Figure 13:
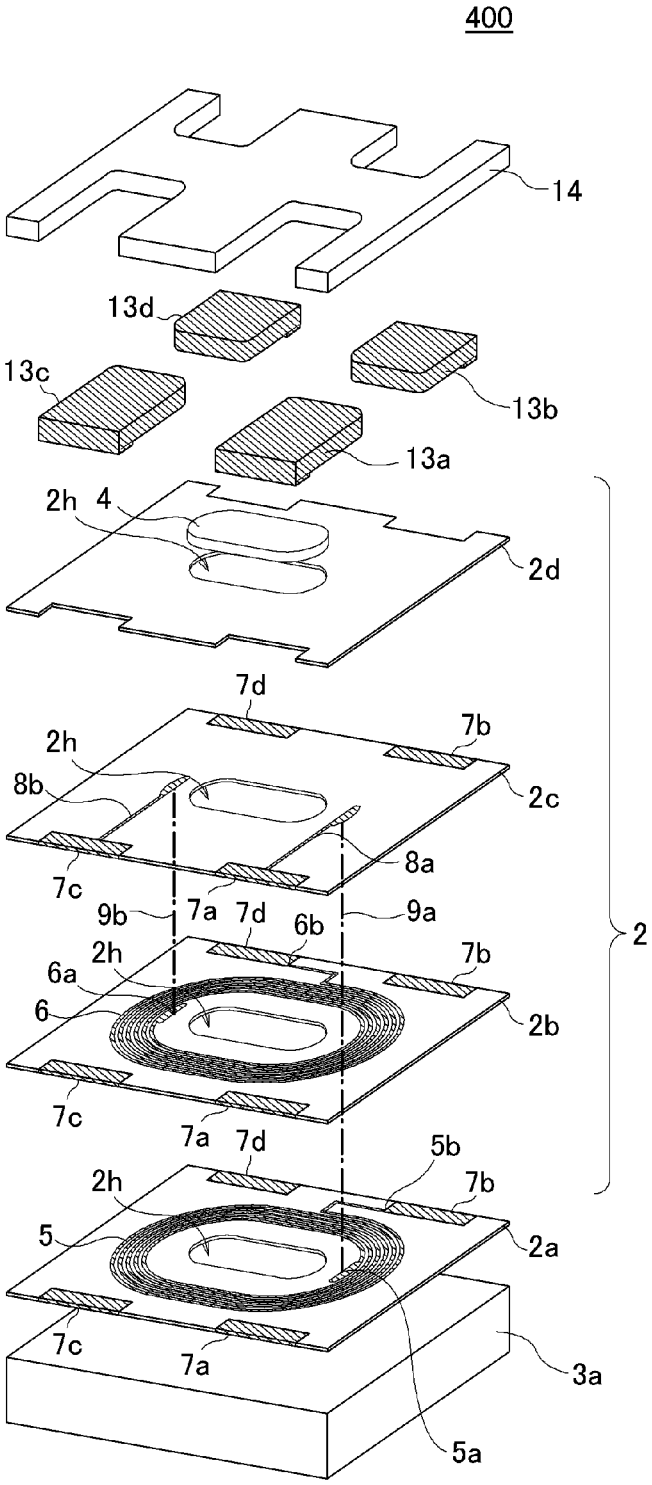
FIG. 13 is a schematic exploded perspective view showing the layer structure of an electronic component 400 according to the fourth embodiment of the present invention.

FIG. 13 is a schematic exploded perspective view showing the layer structure of an electronic component 400 according to the fourth embodiment of the present invention.

Figure 16:
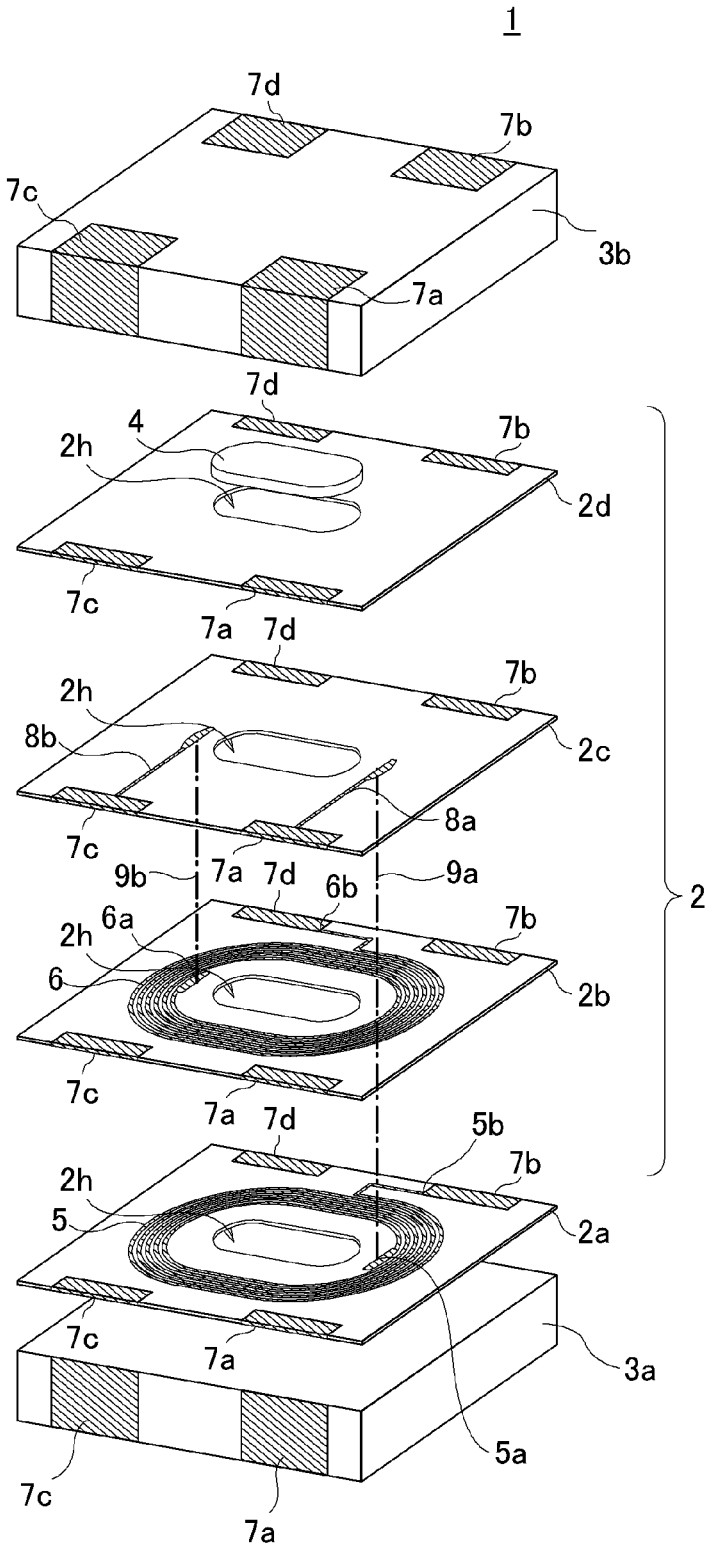
FIG. 16 is a schematic exploded perspective view showing an example of the structure of a conventional surface-mounted common mode filter.

As shown in FIG. 13, the electronic component 400 according to the present embodiment is an electronic component having the first to fourth bump electrodes 13*a* to 13*d* formed on the surface of the conventional thin-film element layer (thin-film coil layer) 2 shown in FIG. 16. Thus, the thin-film element layer 2 has four layers of the first to fourth insulating layers 2*a* to 2*d* and the first and second lead conductors 8*a*, 8*b* are formed on the surface of the insulating layer 2*d* in the thin-film element layer 2. The internal peripheral ends 5*a*, 6*a* of the first and second spiral conductors 5, 6 are connected to the first and third bump electrodes 13*a*, 13*c* via the first and second lead conductors 8*a*, 8*b*. The other configuration is substantially the same as the configuration of the electronic component 100 according to the first embodiment and the same reference numerals are attached to the same elements and a detailed description thereof is omitted.

Thus, also in the present embodiment, the first and third bump electrodes 13*a*, 13*c* exposed to the surface of the insulator layer 14 are larger than the second and fourth bump electrodes 13*b*, 13*d* and therefore, a terminal electrode pattern whose orientation of mounting can visually be recognized can be provided.

Figure 14:
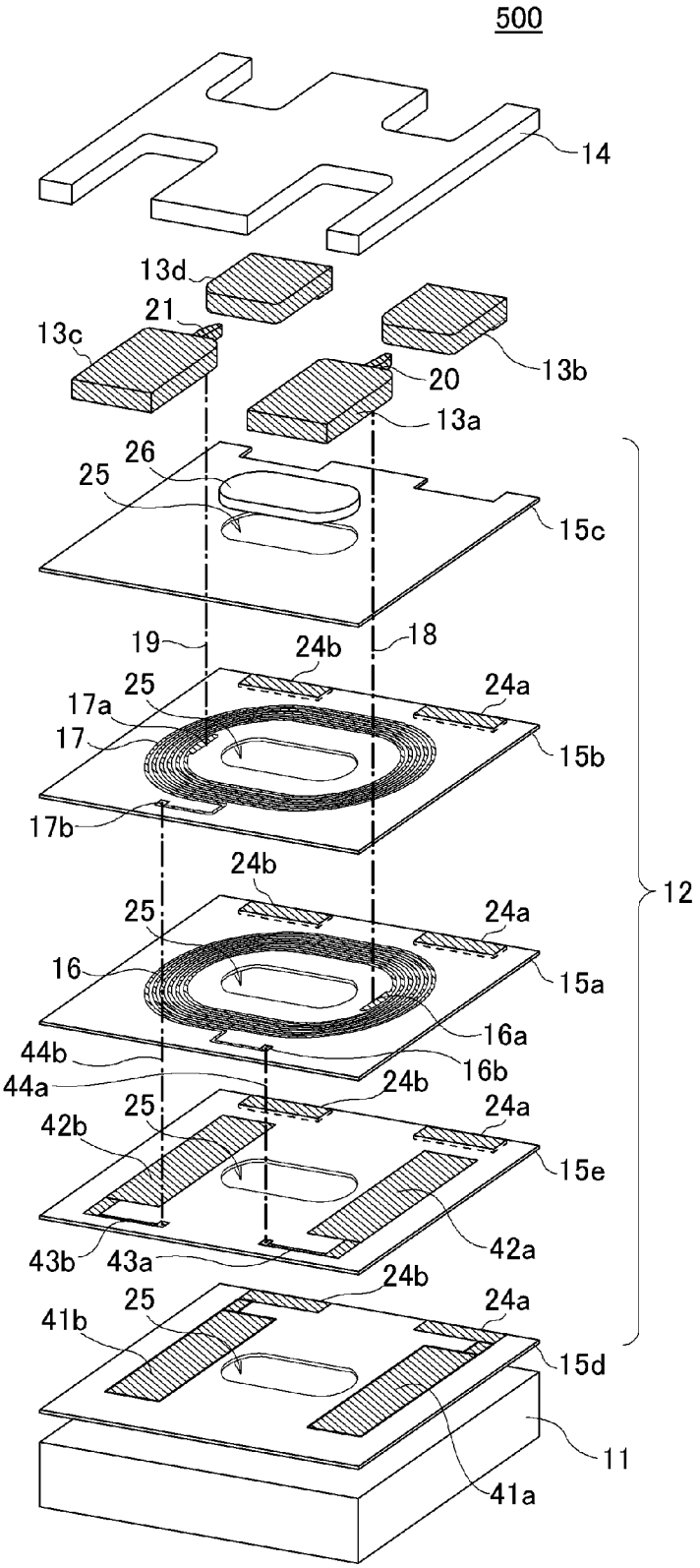
FIG. 14 is a schematic exploded perspective view showing the layer structure of an electronic component 500 according to the fifth embodiment of the present invention.

FIG. 14 is a schematic exploded perspective view showing the layer structure of an electronic component 500 according to the fifth embodiment of the present invention.

As shown in FIG. 14, the electronic component 500 according to the present embodiment is characterized in that the thin-film element layer 12 further includes, in addition to a common mode filter (first element) composed of the spiral conductors 16, 17, a circuit element pattern (second element) composed of a pair of capacitors. More specifically, the thin-film element layer 12 includes insulating layers 15*d*, 15*e* stacked sequentially, flat electrodes 41*a*, 41*b* and the terminal electrodes 24*a*, 24*b* formed on the surface of the insulating layer 15*d*, and flat electrodes 42*a*, 42*b* and the terminal electrodes 24*a*, 24*b* formed on the surface of the insulating layer 15*e*. The added insulating layers 15*d*, 15*e* are provided between the substrate 11 and the insulating layer 15*a*.

The flat electrodes 41*a*, 42*a* are opposite to each other across the insulating layer 15*e* and constitute a first capacitor C1. The flat electrodes 41*b*, 42*b* are also opposite to each other across the insulating layer 15*e* and constitute a first capacitor C2. To increase electrostatic capacity of a capacitor, it is preferable to use a material such as alumina (Al2O3), silicon nitride (Si3N4), and barium titanate (BaTiO3) having a high dielectric constant for the insulating layer 15*e*. The one flat electrode 41*a* of the first capacitor C1 is connected to the terminal electrode 24*a* and the other flat electrode 42*a* is connected to the external peripheral end 16*b* of the first spiral conductor 16 via the lead conductor 43*a* and a contact hole conductor 44*a*. The one flat electrode 41*b* of the second capacitor C2 is connected to the terminal electrode 24*b* and the other flat electrode 42*b* is connected to the external peripheral end 17*b* of the second spiral conductor 17 via the lead conductor 43*b* and a contact hole conductor 44*b*.

If, when the electronic component 500 according to the present embodiment is mounted on a pair of signal lines, the first and third bump electrodes 13*a*, 13*c* are connected to a pair of input terminals of the signal lines, a common mode filter is directly connected to the pair of input terminals. If the second and fourth bump electrodes 13*b*, 13*d* are connected to the pair of input terminals, the common mode filter is connected to the pair of input terminals via a capacitor. If a capacitor should be caused to function as a portion of a filter element, it is preferable to connect the second and fourth bump electrodes 13*b*, 13*d* to the input side of a pair of signal lines. Thus, the electronic component 500 has the orientation of mounting and because the shape and size of the first and third bump electrodes 13*a*, 13*c* are different from the shape and size of the second and fourth bump electrodes 13*b*, 13*d*, the orientation of mounting can easily be checked.

In FIG. 14, the spiral conductors 16, 17, which are a common mode filter, are formed after the capacitors C1, C2 being formed on the substrate 11, but the capacitors may be formed after the common mode filter being formed if necessary. In such a case, a larger bump electrode may be connected to the capacitor side.

FIGS. 15A to 15F are equivalent circuit diagrams of the electronic component 500.

Figure 15A:
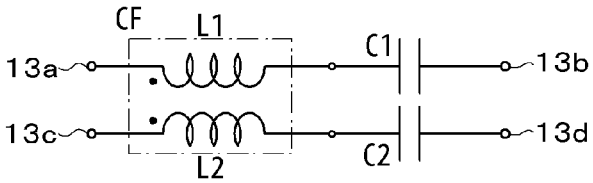
FIGS. 15A to 15F are equivalent circuit diagrams of the electronic component 500.
Figure 15B:
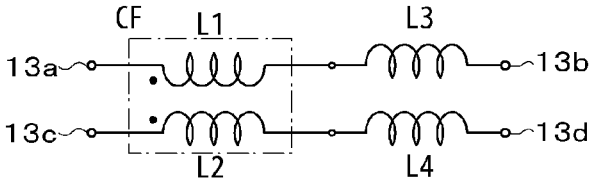
Figure 15C:
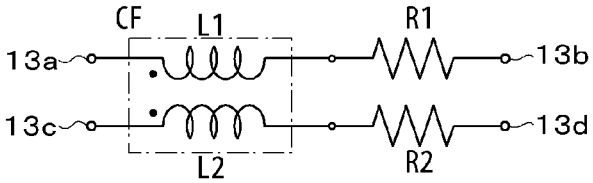
Figure 15D:
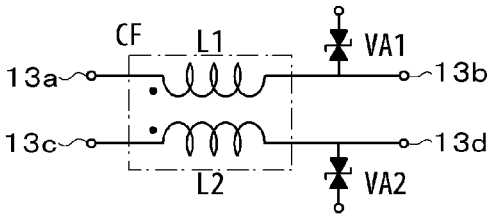

The electronic component shown in FIG. 15A is formed by connecting a pair of coils and a pair of capacitors constituting a common mode filter CF in series respectively and is an equivalent circuit diagram of the electronic component in FIG. 14. FIG. 15B includes a pair of inductors L3, L4, instead of the pair of capacitors C1, C2 and further, FIG. 15C includes a pair of resistors R1, R2. FIG. 15D includes varistors VA1, VA2 connected to the common mode filter CF in parallel.

Figure 15E:
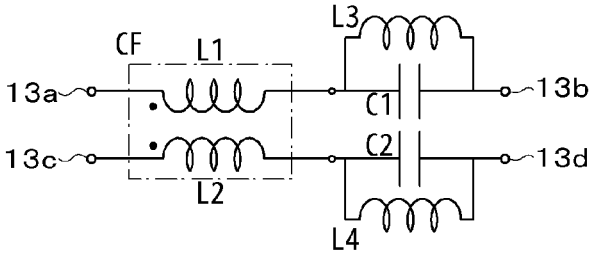
Figure 15F:
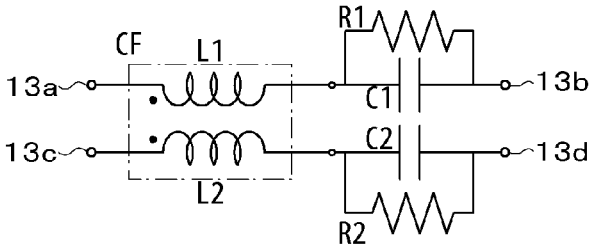

Further, FIG. 15E shows a respective parallel circuit of capacitor and inductor being connected to a pair of coils constituting the common mode filter CF in series and FIG. 15F shows a respective parallel circuit of capacitor and resistor being connected in series. In this manner, various circuits can be adopted as an additional circuit element pattern.

In the electronic components 100, 200, 300, 400 according to the first to fourth embodiments described above, if, for example, an L-shaped conductor portion from an outermost circumference of the spiral conductors 16, 17 to the external peripheral ends 16*b*, 17*b* is considered as an inductor component, the circuits are regarded as asymmetrical and it may be important to grasp the orientation of mounting depending on the frequency of signals to be processed or the necessary noise cut level.

While preferred embodiments of the present invention have been explained above, the present invention is not limited thereto. Various modifications can be made to the embodiments without departing from the scope of the present invention and it is needless to say that such modifications are also embraced within the scope of the invention.

In the above embodiments, for example, the thin-film element layer 12 and the insulator layer 14 are formed on a magnetic wafer, the magnetic wafer is individualized by dicing, and further electroplating is performed after barrel polishing, but the present invention is not limited to the above method and dicing may be performed after the wafer before dicing is electrolessly plated.

Also in the above embodiments, the insulator layer 14 made of composite ferrite is formed on the principal surface of the thin-film element layer 12, but the insulator layer 14 may also be formed of a non-magnetic material. The present invention can be applied to a coil component configured to connect the internal peripheral end of a spiral conductor and an external terminal electrode by a lead conductor and may be applied not only to a coil component of a 4-terminal structure, but also to a coil component of a 2-terminal structure.

The magnetic core 26 is provided in the above embodiments, but the magnetic core 26 is not mandatory. However, the magnetic core 26 can be formed of the same material as the material of the magnetic resin layer 14 and thus, the magnetic core 26 and the magnetic resin layer 14 can be formed simultaneously without undergoing a special process only if the opening 25 is formed.

Further, in the above embodiments, a case when the thin-film element layer contains a common mode filter element composed of first and second spiral conductors is taken as an example, but the present invention does not necessarily need to contain the common mode filter and an element having input/output asymmetry by containing a configuration in which first and second elements with mutually different electric characteristics are connected may be contained. For example, the thin-film element layer 12 may be configured to contain a serially connected circuit of an inductor as the first element and a capacitor as the second element.

However, the orientation of mounting of a coil component arises in a thin-film common mode filter due to asymmetry of the circuit itself caused by addition of a circuit element and thus, an advantage of the shape and size of the first and second bump electrodes being mutually different is very great. A thin-film common mode filter in the present invention omits one of two magnetic substrates and instead, a magnetic resin layer and bump electrodes are provided and a lead conductor to connect the bump electrodes and the internal peripheral end of spiral conductors can advantageously be omitted by changing the shape and size of the bump electrodes.

What is claimed is:

1. An electronic component comprising:

a substrate;

a thin-film element layer provided on the substrate;

first and second bump electrodes provided on a surface of the thin-film element layer; and an insulator layer provided on the surface of the thin-film element layer and filling a first space between the first bump electrode and the second bump electrode, wherein the thin-film element layer contains a first spiral conductor, which is a plane coil pattern, the first bump electrode is connected to an internal peripheral end of the first spiral conductor, the second bump electrode is connected to an external peripheral end of the first spiral conductor, each of the first and second bump electrodes has a first exposure surface exposed to a principal surface of the insulator layer and a second exposure surface exposed to an end face of the insulator layer, the first exposure surface of the first bump electrode and the first exposure surface of the second bump electrode have different shapes and sizes, and each second exposure surface of the first and second bump electrodes is provided above the thin-film element layer, the electronic component further comprising third and fourth bump electrodes provided on the surface of the thin-film element layer, wherein the thin-film element layer further contains a second spiral conductor magnetically coupled to the first spiral conductor and composed of a plane coil pattern, the insulator layer fills a second space between the first to fourth bump electrodes, the third bump electrode is connected to an internal peripheral end of the second spiral conductor, the fourth bump electrode is connected to an external peripheral end of the second spiral conductor, each of the third and fourth bump electrodes has a first exposure surface exposed to the principal surface of the insulator layer and a second exposure surface exposed to the end face of the insulator layer, the first exposure surface of the third bump electrode and the first exposure surface of the fourth bump electrode have mutually different shapes and sizes, and each second exposure surface of the third and fourth bump electrodes is provided above the thin-film element layer.

2. The electronic component as claimed in claim 1, wherein the first exposure surface of the first bump electrode and the first exposure surface of the third bump electrode have the same shape and size and the first exposure surface of the second bump electrode and the first exposure surface of the fourth bump electrode have the same shape and size.

3. An electronic component comprising:

a substrate;

a thin-film element layer provided on the substrate;

first to fourth bump electrodes provided on a surface of the thin-film element layer; and an insulator layer provided on the surface of the thin-film element layer and filling a space between the first to fourth bump electrodes, wherein the thin-film element layer contains first and second spiral conductors that are magnetically coupled to each other and composed of plane coil patterns, the first bump electrode is connected to an internal peripheral end of the first spiral conductor, the second bump electrode is connected to an external peripheral end of the first spiral conductor, the third bump electrode is connected to an internal peripheral end of the second spiral conductor, the fourth bump electrode is connected to an external peripheral end of the second spiral conductor, each of the first to fourth bump electrodes has a first exposure surface exposed to a principal surface of the insulator layer and a second exposure surface exposed to an end face of the insulator layer, the first exposure surface of the first bump electrode and the first exposure surface of the second bump electrode have different shapes and sizes, and the first exposure surface of the third bump electrode and the first exposure surface of the fourth bump electrode have mutually different shapes and sizes.

4. The electronic component as claimed in claim 3, wherein an area of the first exposure surface of the first bump electrode is larger than that of the second bump electrode, and an area of the first exposure surface of the third bump electrode is larger than that of the fourth bump electrode.

5. The electronic component as claimed in claim 4, wherein the thin-film element layer further contains an insulating layer covering the first spiral conductor, a first contact hole conductor electrically connecting the internal peripheral end of the first spiral conductor and the first bump electrode by passing through the insulating layer, and a second contact hole conductor electrically connecting the internal peripheral end of the second spiral conductor and the third bump electrode by passing through the insulating layer, the first bump electrode is provided so as to cover the first contact hole conductor on the insulating layer, and the third bump electrode is provided so as to cover the second contact hole conductor on the insulating layer.

6. The electronic component as claimed in claim 4, further comprising:

a first lead conductor provided on the surface of the thin-film element layer together with the first to fourth bump electrodes and formed integrally with the first bump electrode; and a second lead conductor provided on the surface of the thin-film element layer together with the first to fourth bump electrodes and formed integrally with the third bump electrode, wherein the thin-film element layer further contains:

an insulating layer covering the first spiral conductor;

a first contact hole conductor electrically connecting the internal peripheral end of the first spiral conductor and an end of the first lead conductor by passing through the insulating layer; and a second contact hole conductor electrically connecting the internal peripheral end of the second spiral conductor and an end of the second lead conductor by passing through the insulating layer, the first bump electrode is connected to the first contact hole conductor via the first lead conductor, and the third bump electrode is connected to the second contact hole conductor via the second lead conductor.

7. The electronic component as claimed in claim 3, wherein the first exposure surface of the first bump electrode and the first exposure surface of the third bump electrode have the same shape and size, and the first exposure surface of the second bump electrode and the first exposure surface of the fourth bump electrode have the same shape and size.

8. An electronic component comprising:

a substrate;

a thin-film element layer provided on the substrate;

first and second bump electrodes provided on a surface of the thin-film element layer; and an insulator layer provided on the surface of the thin-film element layer and filling a first space between the first bump electrode and the second bump electrode, wherein the thin-film element layer contains a first spiral conductor, which is a plane coil pattern, the first bump electrode is connected to an internal peripheral end of the first spiral conductor, the second bump electrode is connected to an external peripheral end of the first spiral conductor, both of the first and second bump electrodes have a first exposure surface exposed to a principal surface of the insulator layer and a second exposure surface exposed to an end face of the insulator layer, the first exposure surface of the first bump electrode and the first exposure surface of the second bump electrode have different shapes and sizes, and a thickness of each of the first and second bump electrodes is five-times or more than that of the first spiral conductor, the electronic component further comprising third and fourth bump electrodes provided on the surface of the thin-film element layer, wherein the thin-film element layer further contains a second spiral conductor magnetically coupled to the first spiral conductor and composed of a plane coil pattern, the insulator layer fills a second space between the first to fourth bump electrodes, the third bump electrode is connected to an internal peripheral end of the second spiral conductor, the fourth bump electrode is connected to an external peripheral end of the second spiral conductor, both of the third and fourth bump electrodes have a first exposure surface exposed to the principal surface of the insulator layer and a second exposure surface exposed to the end face of the insulator layer, the first exposure surface of the third bump electrode and the first exposure surface of the fourth bump electrode have mutually different shapes and sizes, and a thickness of each of the first to fourth bump electrodes is five-times or more than that of the first and second spiral conductor.

9. The electronic component as claimed in claim 8, wherein an area of the first exposure surface of the first bump electrode is larger than that of the second bump electrode.

10. The electronic component as claimed in claim 8, wherein the thin-film element layer further contains an insulating layer covering the first spiral conductor, and a first contact hole conductor electrically connecting the internal peripheral end of the first spiral conductor and the first bump electrode by passing through the insulating layer, and wherein the first bump electrode is provided so as to cover the first contact hole conductor on the insulating layer.

11. The electronic component as claimed in claim 8 further comprising a first lead conductor provided on the surface of the thin-film element layer together with the first and second bump electrodes and formed integrally with the first bump electrode, wherein the thin-film element layer further contains an insulating layer covering the first spiral conductor, and a first contact hole conductor electrically connecting the internal peripheral end of the first spiral conductor and an end of the first lead conductor by passing through the insulating layer, and wherein the first bump electrode is connected to the first contact hole conductor via the first lead conductor.

12. The electronic component as claimed in claim 8, wherein the first exposure surface of the first bump electrode and the first exposure surface of the third bump electrode have the same shape and size, and the first exposure surface of the second bump electrode and the first exposure surface of the fourth bump electrode have the same shape and size.

* * * * *